US005488843A

United States Patent [19]

Shi

[11] Patent Number: 5,488,843

[45] Date of Patent: Feb. 6, 1996

[54] SAFETY, INSURANCE AND ALARM MECHANICAL LOCK

[76] Inventor: Chunmin Shi, No. 2-102, Bldg. 17, Xiaoqu 25, Tangshan, Hebei Province, China

[21] Appl. No.: 127,612

[22] Filed: Sep. 28, 1993

[30] Foreign Application Priority Data

Sep. 28, 1992 [CN] China ..... 92 111008.1

[51] Int. Cl.[6] ..... E05B 63/14

[52] U.S. Cl. ..... 70/1.5; 70/389; 70/DIG. 49; 70/37.9 A; 70/406; 70/421; 70/375

[58] Field of Search ..... 70/419, 379 R, 70/379 A, 1.5, 375, 420, 421, 358, 389, DIG. 49, 406, 405

[56] References Cited

U.S. PATENT DOCUMENTS

| | | | |
|---|---|---|---|
| 3,442,102 | 5/1969 | Butts | 70/1.5 |
| 3,863,476 | 2/1975 | Patriquin | 70/375 |
| 4,114,412 | 9/1978 | Braatz | 70/DIG. 49 |
| 4,186,578 | 2/1980 | Sommer | 70/419 |
| 4,262,506 | 4/1981 | Töbel | 70/419 |
| 4,328,692 | 5/1982 | Dice et al. | 70/421 |
| 5,079,936 | 1/1992 | Stefanek | 70/358 |
| 5,148,690 | 9/1992 | Wang | 70/358 |
| 5,372,024 | 12/1994 | Rückert | 70/406 |

FOREIGN PATENT DOCUMENTS

| | | | |
|---|---|---|---|
| 2333715 | 3/1974 | Germany | 70/DIG. 49 |

*Primary Examiner*—Darnell M. Boucher
*Attorney, Agent, or Firm*—Jacobson, Price, Holman & Stern

[57] ABSTRACT

A safety, insurance and alarm mechanical lock contains an external lock portion, a multicylinder type lock cylinder portion, and a lock body portion engaging with the lock cylinder portion. The lock cylinder portion comprises a front part including an external cylinder, a middle cylinder and an internal cylinder and a back part including a back external cylinder and a back internal cylinder. A self-locking control mechanism is provided between the front and back lock cylinders which can automatically perform self-locking and alarming when destroying act applied to the lock cylinder from outside takes place. The lock body portion is provided with an internal lock mechanism. Furthermore, in accordance with the various requirement, it can also be provided with an anti-invading mechanism, an alarm mechanism sensing the deformation of the door. The lock of the present invention has overcome many disadvantages of the prior lock and give a great deal of safety to users.

10 Claims, 25 Drawing Sheets

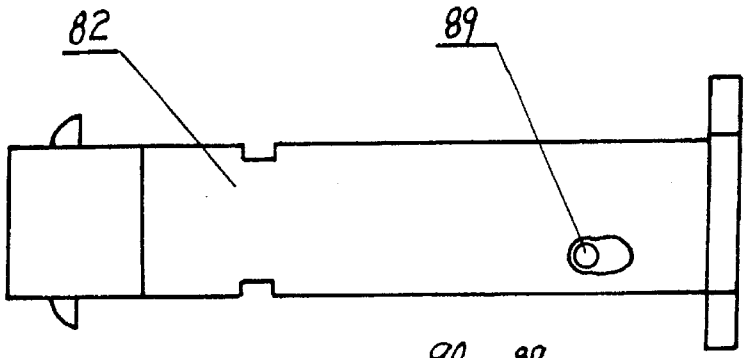
FIG. 17
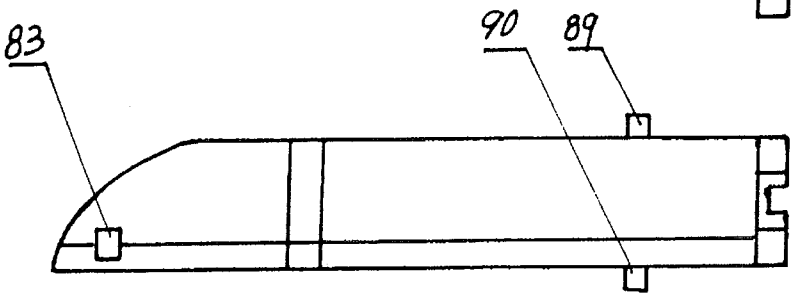
FIG. 18
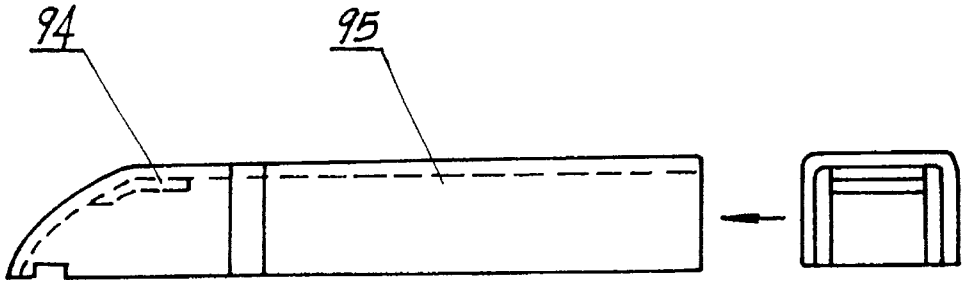
FIG. 19B
FIG. 19A

SAFETY, INSURANCE AND ALARM MECHANICAL LOCK

BACKGROUND OF THE INVENTION

The present invention is related to a lock, and especially to a mechanical lock.

At present, the mechanical lock has been widely used. This kind of lock generally comprises three components: a lock cylinder, a lock body and a lock tongue chamber. This lock can be widely used in the room door, insurance frame storehouse, secret room etc. Although this lock is used conveniently, there are a lot of disadvantages in it. Due to the exposure of the key hole, the lock can be unlocked and the key hole may be blocked up from outside by a poor behaving person using a key institute. Also, it can be unlocked by using a destroying means such as drilling, digging out the lock cylinder, to drive the driving rod of the lock cylinder to rotate and so on. Additionally, due to the lock which has no perfect alarm function, the above mentioned illegal act of the poor behaving person is sometimes difficult to be discovered thus causing the illegal act to be achieved.

Considering above mentioned disadvantages, the object of the present invention is to provide a mechanical lock, the key hole of which is not exposed, the lock cylinder of which only can be operated by using a specific key and the lock body of which can be automatically self-locked in case of emergency.

SUMMARY OF THE INVENTION

To this end, the present invention provides a mechanical lock, in which, a lock cylinder comprises a front lock cylinder and a back lock cylinder, also a self-locking control mechanism and a moving section control mechanism;

said front lock cylinder is composed of a front external cylinder, a front middle cylinder and a front internal cylinder; two pin sets, each of which is arranged longitudinally, are provided in the front cylinder; the positioning groove of the internal cylinder is communicated with the key hole, so that after rotation of the internal cylinder the positioning pin of the internal cylinder is fitted with the anti-drawout groove of the key, whereby the key is not permitted to be drawn out from the key hole;

said back lock cylinder is composed of a back external cylinder and a back internal cylinder, in which a pin-set-like arrangement is provided; said back internal cylinder is fastened rigidly together with the middle cylinder of the front lock cylinder and said front external cylinder is fastened rigidly together with the back external cylinder; a driving rod is connected rigidly with said back internal cylinder;

said self-locking control mechanism consists of a self-locking control plate, connecting rods and a self-locking control rod; said self-locking control plate is located between the front and back lock cylinders and can drive the connecting rods and the self-locking control rod to move toward the front lock cylinder; the self-locking control rod extends out from the lock cylinder;

said moving section control mechanism is composed of a V-shape element which is used to drive a moving section control rod to rotate, a ball and bar mechanism which is raised up with the rotation of the lock cylinder and then moves the bar to rotate the V-shape element, and the moving section control rod which extends out from the lock cylinder;

a lock body portion includes a body and a bottom plate; said bottom plate is secured on the door; an external moving section, an external moving head and a self-locking control pin are provided in serial on the side of the bottom plate facing the body; said moving section control rod is fitted with said external moving section; said moving section is used to control the movement of the external moving head and can be rotated to release said external moving head by said moving section control rod; said self-locking control pin is pushed by said self-locking control rod extending into the said body portion;

said driving rod from the lock cylinder portion is fitted with said external moving head used for controlling the movement of a lock tongue;

said body portion has the lock tongue; an internal moving head whose movement can be controlled from the interior of the room is provided to control the position of the lock tongue; a self-locking element with the spring alarm sheet is located below the lock tongue and hinged to the lock body portion; one end of the self-locking element is controlled by the self-locking control pin, and its other end can engage with the lock tongue when the lock tongue is inserted in a lock tongue chamber; an internal lock mechanism is provided and controlled by secret code disks;

said lock tongue chamber is provided to fit with the lock tongue.

Preferably, the lock of the invention further includes an external lock portion which contains a close door, a close door control mechanism and a pressing ring around the entire external lock portion;

said close door is provided with a rod arranged rotatably in the lock cylinder and a lock hook;

said close door control mechanism is composed of secret code disks, secret code bottom disks, each of which is connected with each of the secret code disks by a shaft and has a recess on its outer periphery, a displacement element controlled by the secret code bottom disks with its lower feet capable of inserting into the recesses of the secret code bottom disks, a knob executing element fitted with the displacement element, a knob connected pivotably with said knob executing element at its one end, a L-shape operating element controlled by said knob executing element, a lock head moved by said L-shape operating element capable of locking and releasing the lock hook of the close door, and a spring and bar mechanism to raise the close door.

Preferably, said internal lock mechanism includes two secret code disks and an internal lock arm; a recess is formed in each bottom disk of said two secret code disks; projections are provided on the said internal lock arm; when the secret code disks are in the state that their secret codes marked thereon in mess condition and that the lock tongue is inserted in the lock tongue chamber, the internal lock arm locks the internal moving head enabling it not to be turned by external force; when the secret code disks are in the condition that their secret codes correctly oriented, the internal lock arm is disconnected with the internal moving head.

Preferably, T-shape pins pressed by spring pieces are provided in the pin chambers of said back lock cylinder; alarm contact sheets insulated from the T-shape pins are provided on the outer surface of the back external cylinder and correspond to the positions of the T-shape pins; said alarm contact sheets and said spring sheets are connected with an alarm electrical circuit respectively.

Preferably, said lock tongue is a hollow one with anti-moving heads which protrude outside the tongue; a control mechanism controlling the anti-moving heads to be got in and out is provided in the lock tongue; said mechanism comprises levers hinged to the anti-moving heads, a cone pulling element, a lower moving wheel and an upper moving wheel; said upper and lower moving wheels are of circular segment shape with their cut sections being pressed against one end of the cone pulling element, and are hinged to the lock tongue by the same pin; a reinforced plate is welded in the lock tongue.

Preferably, the lock of the present invention further contains an anti-invading mechanism which includes a moving bolt with its bush, a plate, a short element, a cross rod and an alarm rod; said bush of the moving bolt is provided below the lock body with the moving bolt installed inside it; said plate is connected with the tongue chamber, and hinged to one end of the short element; the other end of the short element and the cross rod are hinged to the tongue chamber; the cross rod is also hinged to the alarm plate; an alarm contact sheet is provided on the tongue chamber and face, but not contact with,the alarm plate; and the alarm contact sheet and the alarm plate are connected with the alarm electrical circuit respectively.

Preferably, the lock of the present invention contains an alarm mechanism for sensing the deformation of the room door; said mechanism comprises an alarm finger hinged to the lock body portion or the tongue chamber portion, a finger base secured on the door or the door frame and also pivotably connected with the alarm finger, and an alarm contact sheet facing the alarm finger; the alarm finger and the alarm contact sheet are connected with the alarm electrical circuit respectively.

Preferably, alarm contact sheets are provided between the bottom plate of said lock body and the door and between the bottom plate of the tongue chamber and corresponding portion of the door frame; insulating papers are provided between said alarm contact sheet and the corresponding portions of the lock body, lock tongue chamber, door and door frame; said alarm contact sheets and said corresponding portions are connected with the alarm electrical circuit respectively.

Preferably, the width of the side plates of the lock tongue and the tongue chamber are 100–120 mm, the bolt holes on said side plates are inclined ones oriented toward the lock body and the tongue chamber respectively.

The present invention also provide a key adapted to fit with the mechanical lock mentioned above which comprises two upper bit surfaces for two sets of the longitudinally arranged pins, an longitudinal bit surface, a groove at its bottom side and two steps.

Further object and advantages of the invention will appear from the following description taken together with the accompanying drawings.

BRIEF DESCRIPTION OF THE ACCOMPANYING DRAWINGS

FIG. 17 is a schematic view of the exterior configuration of the lock tongue according to the invention.

FIG. 18 is a side view of the lock tongue shown in FIG. 17.

FIG. 19A is a schematic view of the surface plate of the lock tongue according to the invention.

FIG. 19B is a schematic side view of the lock tongue in FIG. 19A.

DETAILED DESCRIPTION OF THE PREFERRED EMBODIMENTS

According to the first embodiment of the invention, the present invention provides such a mechanical lock that comprises a lock cylinder portion, a lock body portion installed in the interior side of the door and a lock tongue chamber installed correspondingly to the lock body portion.

The lock cylinder portion is installed inside the door body with a driving rod 32, a self-locking control rod 33 and a moving section control rod 31 extending therefrom into the lock body to fit with their corresponding mechanisms which will be detailed described below.

Figure 6:
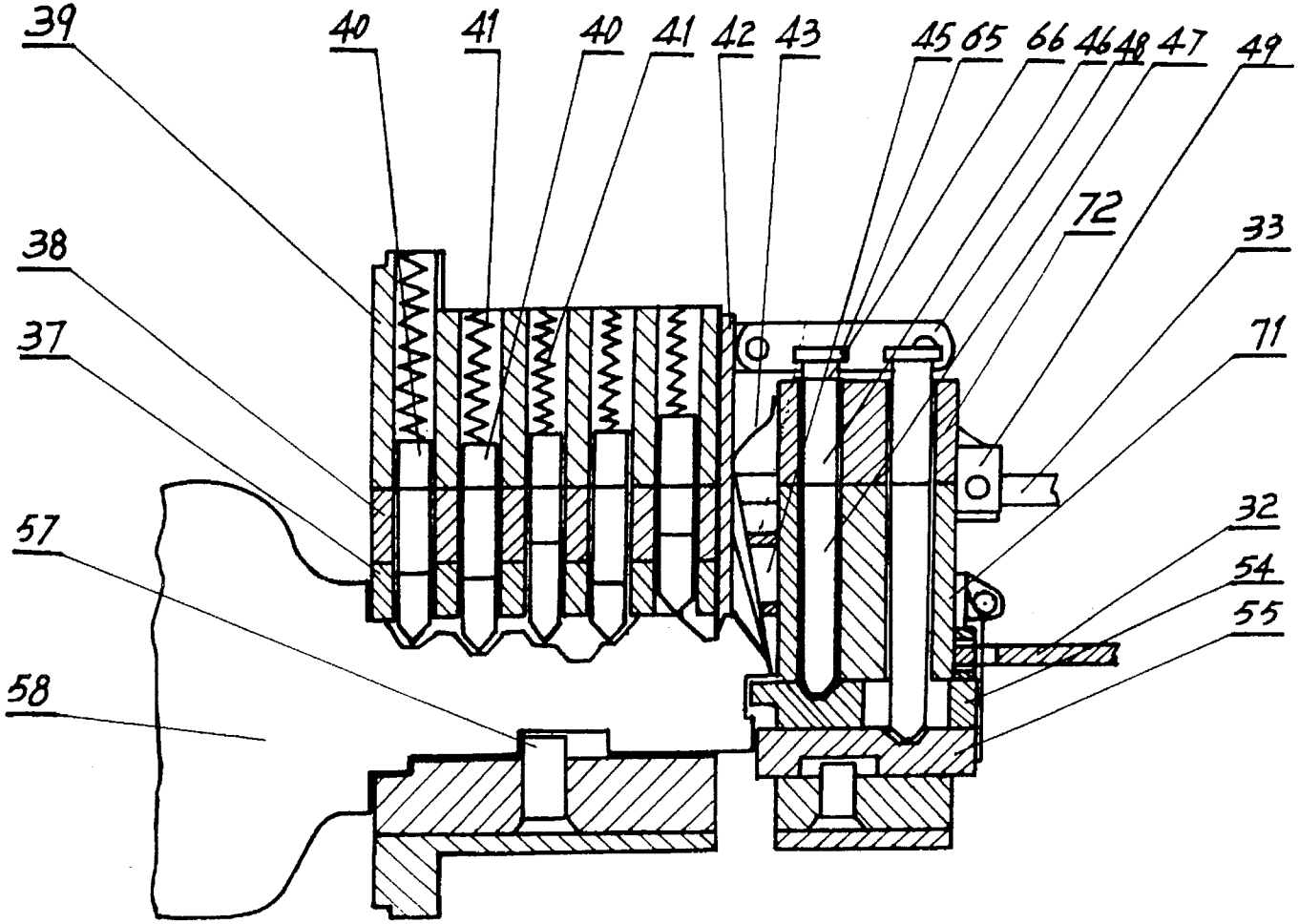
FIG. 6 is a schematic view showing the fitting of the entire lock cylinder with the key according the present invention after the key finishes its further insertion.
Figures 8, 8A, 8B, 8C:
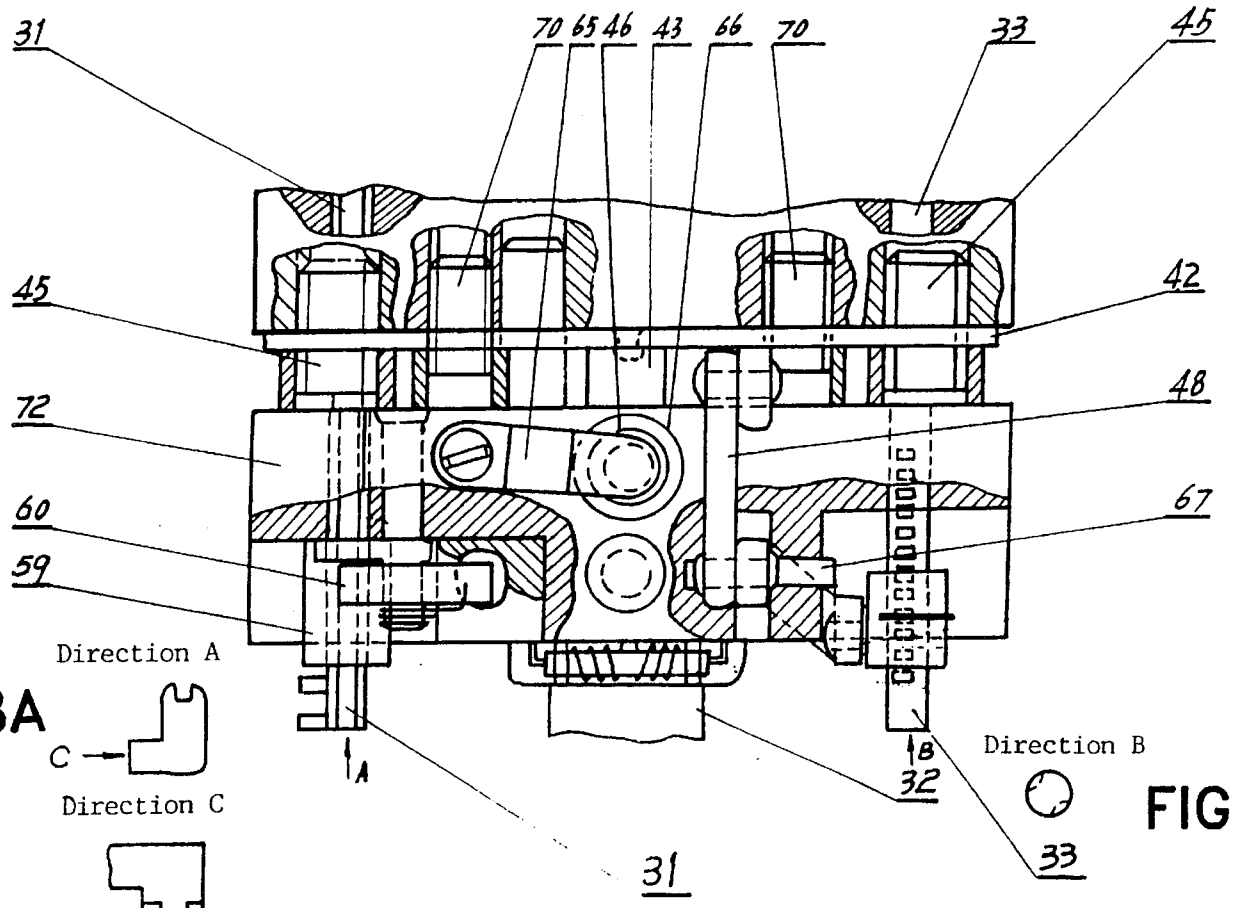
FIG. 8 is a view of connection of the front and back cylinders according to the present invention.
FIG. 8A is a view taken in the direction of arrow A in FIG. 8.
FIG. 8B is a view taken in the direction of arrow B in FIG. 8.
FIG. 8C is a view taken in the direction of arrow C in FIG. 8A.

The lock cylinder portion of the present invention comprises a front lock cylinder and a back lock cylinder, as shown in FIG. 6. The front lock cylinder includes a front internal cylinder 37, a front middle cylinder 38 and a front external cylinder 39. The back lock cylinder includes a back external cylinder 72 which has a circular segment shape with a cut surface and a back internal cylinder 71. The front external cylinder 39 and the back external cylinder 72 are fastened together by bolts 45, and the front middle cylinder 38 and the back internal cylinder 71 are fastened together by bolts 70, as shown in FIG. 8. There are two pin sets, which is arranged longitudinally, in the front lock cylinder: first pin set 77 with its spring 78 and the second pin set 40 with its spring 41. The back lock cylinder is provided with a pin-set-like arrangement, i.e. the upper half pin 54, which is in the shape of half column, the lower half pin 55, which is also in the shape of half column, long pins 47 and T-shape pins 46 which are arranged in the pin chambers of the back cylinder and on the long pins 47. Two corresponding pin springs are arranged to push two pins 54 and 55. By means of the axial movement of the two pins 54,55 to move the long pins 47 and the T-shape pins 46 upward and downward to hinder or release the rotation of the back internal cylinder 71. Alarm contact sheets 66 are arranged under the bottom surfaces of the heads of the T-shape pins 46 and on the cut surface of the external cylinder 72. The T-shape pins and their corresponding alarm contact sheets are respectively connected a alarm electrical circuit. The driving rod 32 used to control the movement of the external moving head 130 of the lock body is secured tightly on the back internal cylinder 71.

Figure 5:
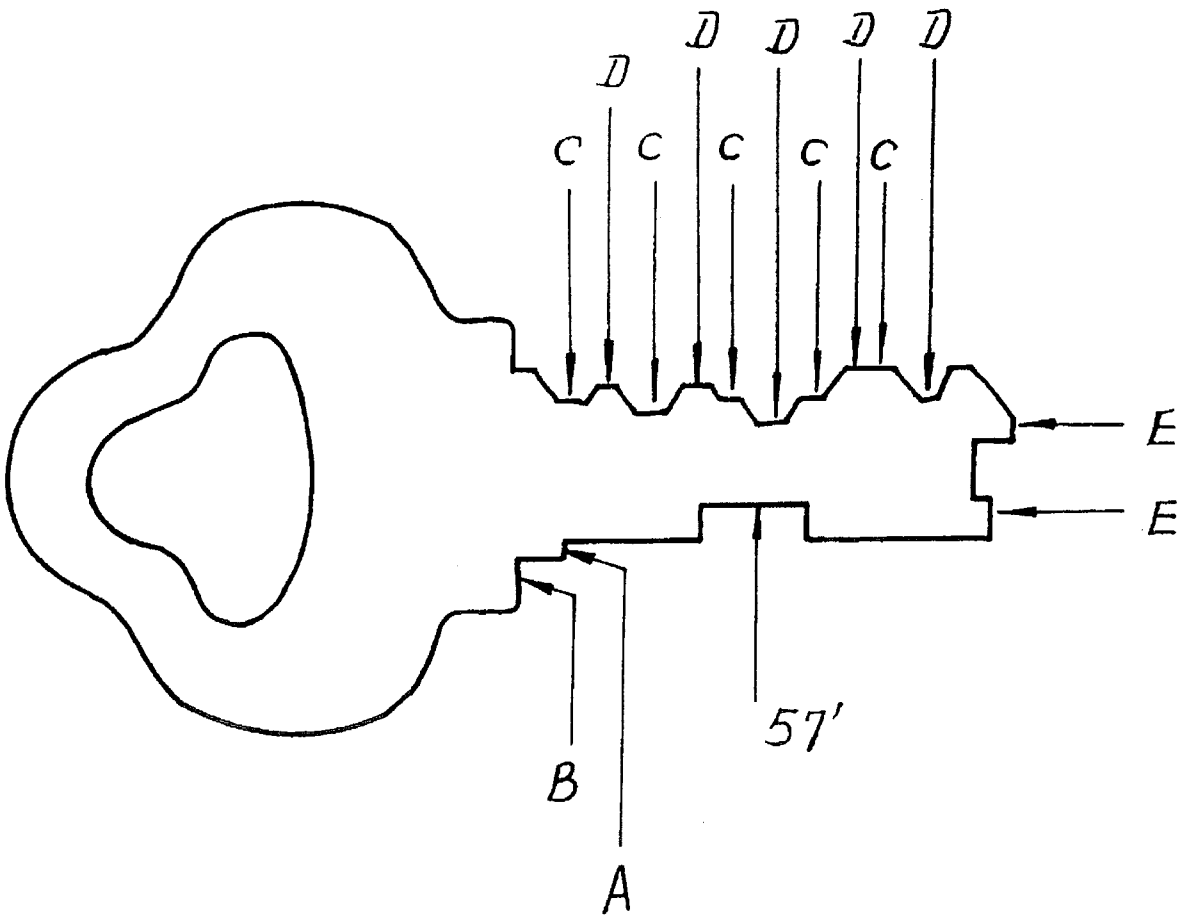
FIG. 5 is a side view of the key according to the present invention.

FIG. 5 shows a schematic view of the key 58 adapted to fit with the lock cylinder portion of the present invention, in which "D" denotes its first bit surface to engage with the first pin set 77, "C" denotes the second bit surface to engage to the second pin set 40, "E" denotes a front longitudinal bit surface to engage with the pin-set-like arrangement in the back lock cylinder, "A" denotes the first step, "B" denotes the second step, and the numeral 57' indicates an anti-drawout groove. The first step A is used to position the key 58 when the key 58 is inserted in the lock cylinder firstly and the second step B is the second positioning point of the key 58 when the key 58 is further inserted in the lock cylinder. The anti-drawout groove 57' is formed at the bottom side thereof and used to fit the anti-drawout positioning pin 57 in the lock cylinder thus preventing the key from drawing out when the key finishes the first operation and prepare to perform the second operation.

Figure 12:
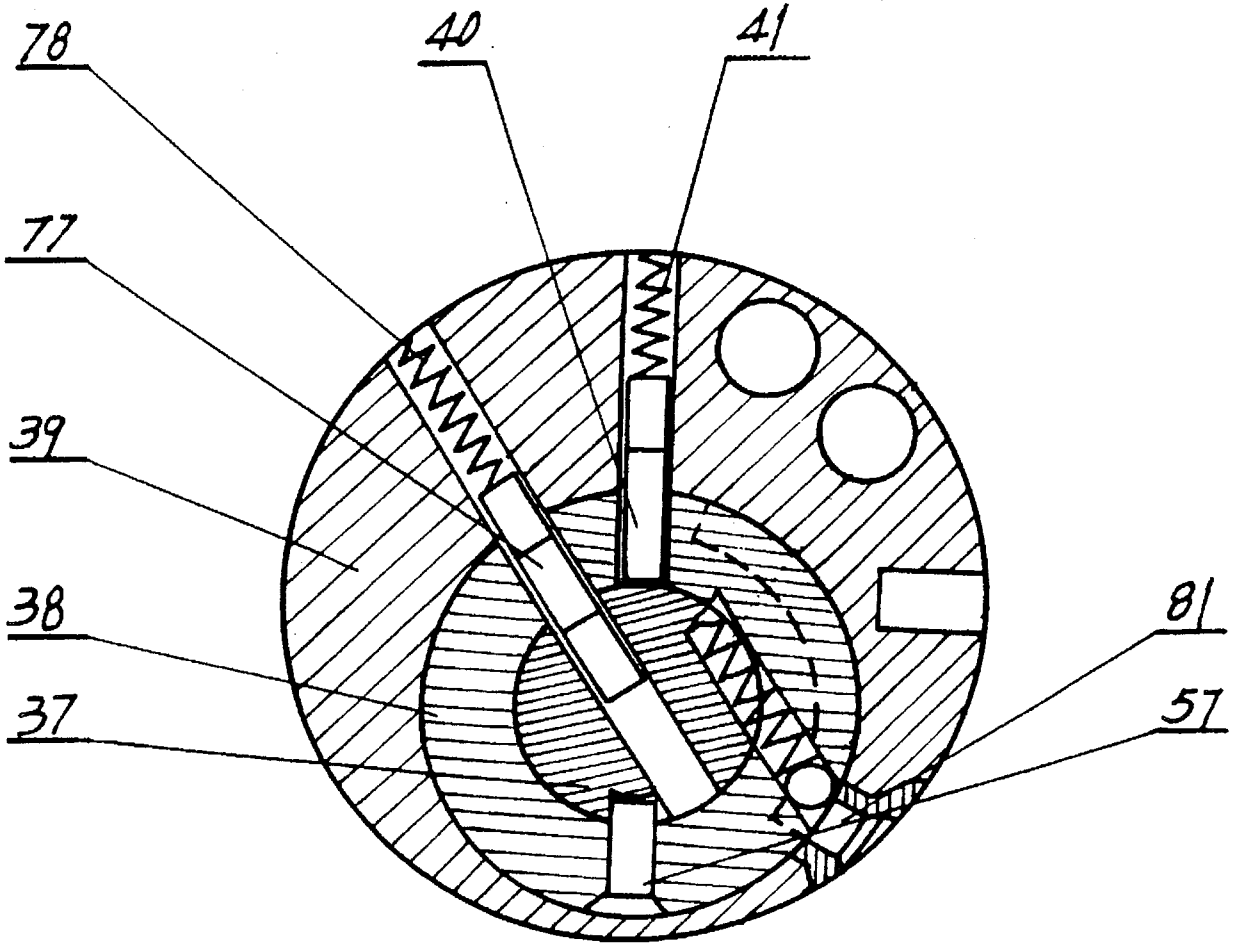
FIG. 12 is a cross sectional view of the front lock cylinder when the key is not inserted therein according to the invention.
Figure 13:
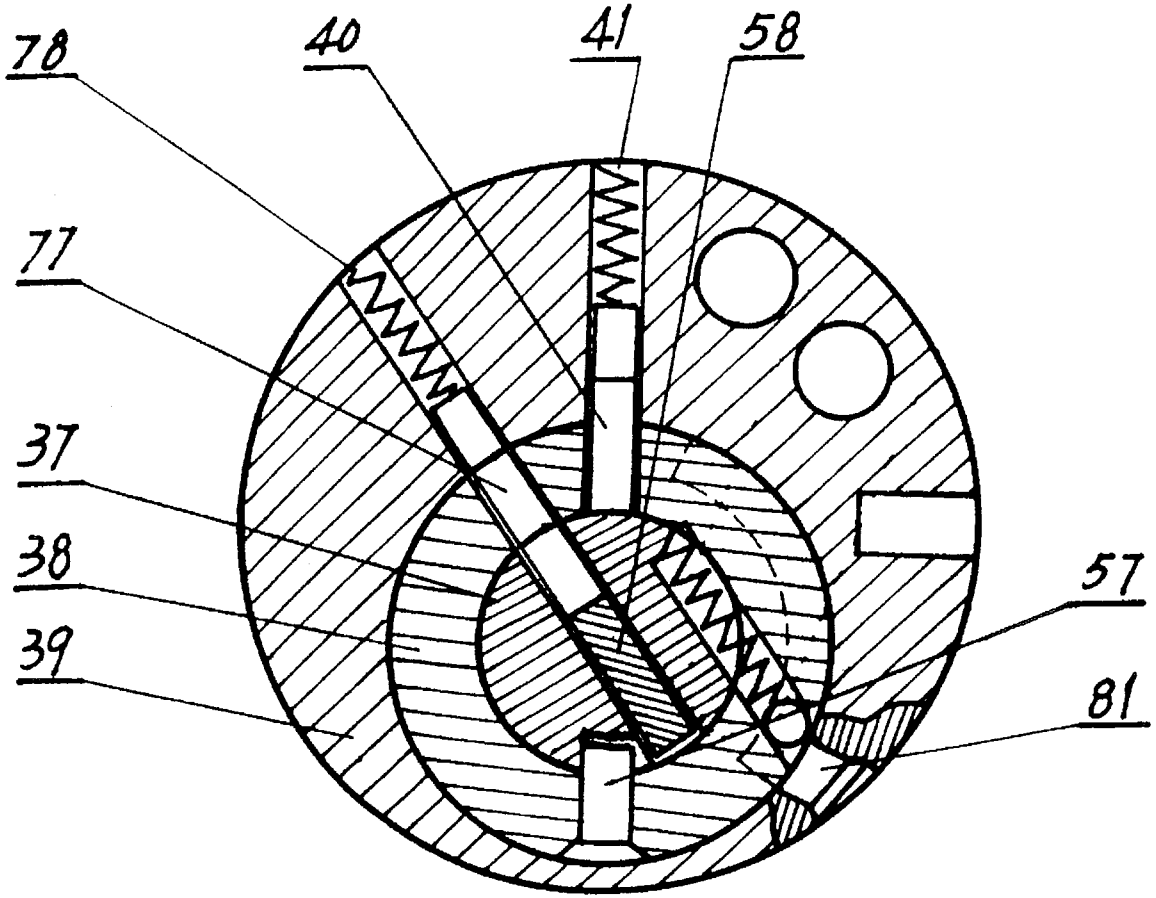
FIG. 13 is a schematic view of the fitting construction of the front lock cylinder with the key according to the invention when the key is just inserted therein.
Figure 14:
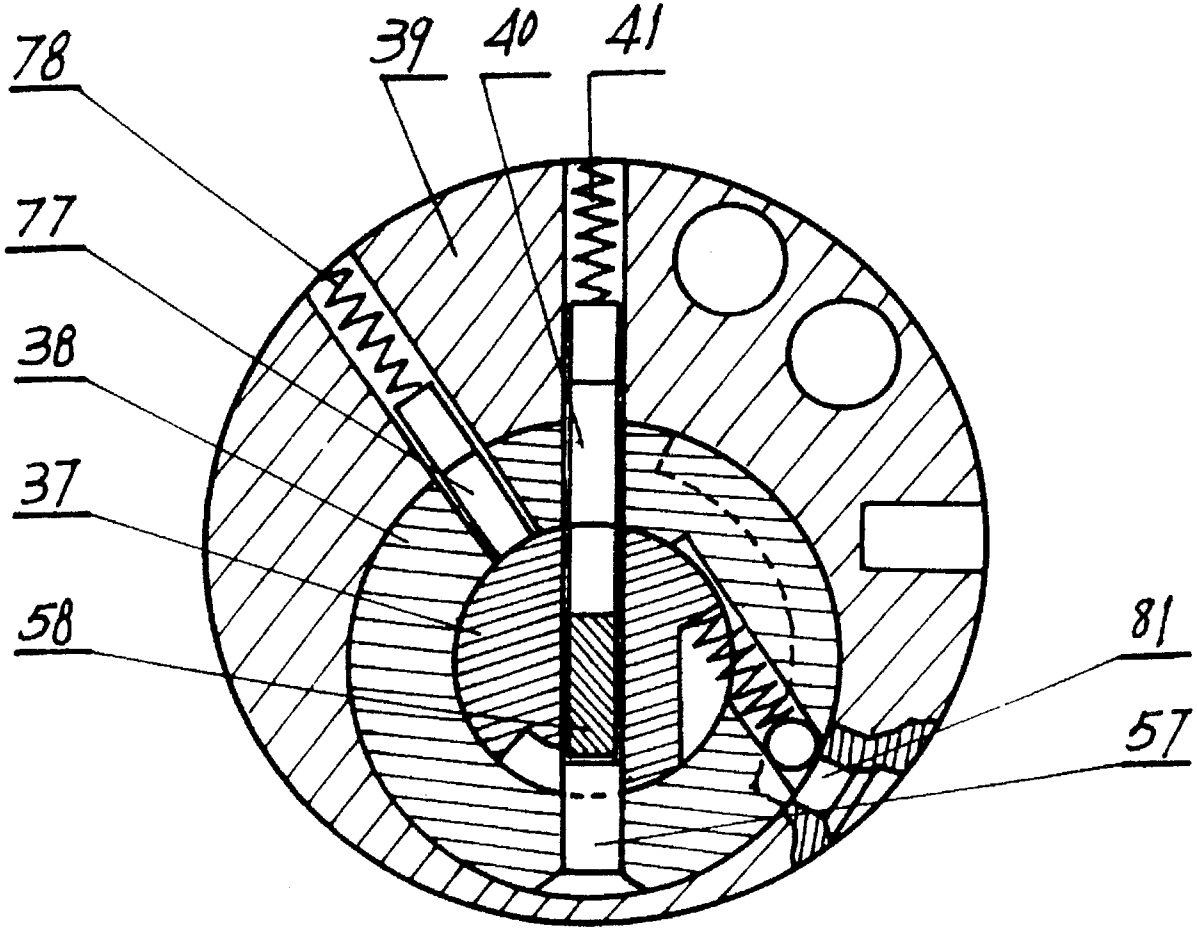
FIG. 14 is a schematic view of the fitting construction of the front lock cylinder with the key according to the invention when the key finishes the first operation.

FIG. 12 shows a cross sectional view of the lock cylinder portion when the key is not inserted therein. From FIG. 12, it is clear that because of hinder action of the first pin set 77 and the second pin set 40 the cylinders can not rotate one relative another. From FIG. 13, it can be seen that, after insert of the key and by means of positioning of the first step A, the first bit surface D of the key 58 is fitted with the first longitudinally arranged pin set 77 causing the front internal cylinder 37 to be in the state capable of rotating with relation to both the middle cylinder 38 and the external cylinder 39. Turning the key 58 causes the internal cylinder 37 to rotate. The positioning groove in the internal cylinder 37 is communicated with the key hole. By means of the positioning pin 57, which is fixed in the front middle cylinder 38 and moves along the positioning groove of the cylinder 37, the key 58 and the internal cylinder 37 can not continue to rotate after they turned synchronistically a definite angle, thus completing the first operation. In this position, a recess formed in the front surface of the middle cylinder 38 permits the key 58 to further insert into the interior of the lock cylinder until the key 58 is positioned by the second step "B". Also in the above position, the pin 57 enters the key, hole along the positioning groove in the internal cylinder 37 to fit with the anti-drawout groove 57', whereby the key can not be drawn out. Therefore, it can effectively prevent the second pin set 40 of the lock cylinder from both probing by other key substitutes and limiting the possibility of using a universal key and the like instead of the real key to unlock the lock.

Figure 15:
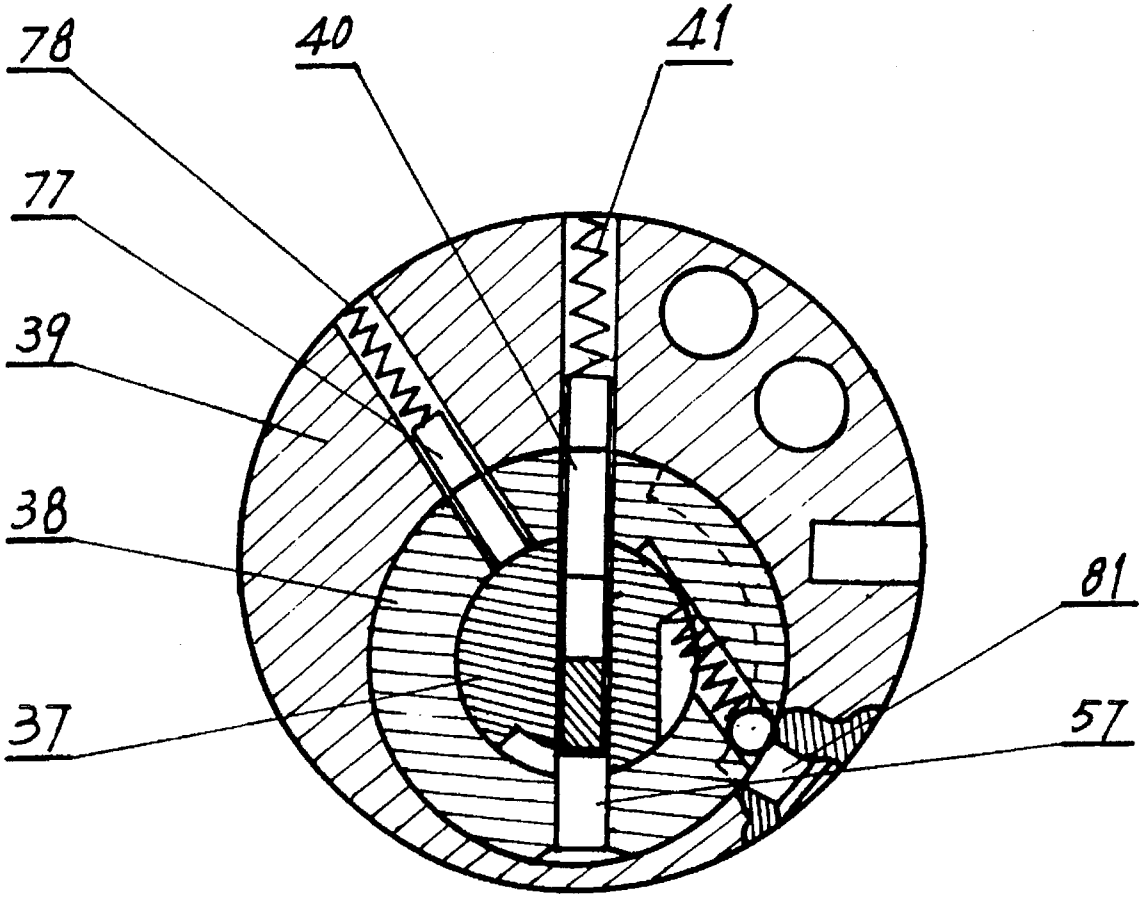
FIG. 15 is a schematic view of the fitting construction of the front lock cylinder with the key according to the invention when the key is further inserted into the cylinder.
Figure 16:
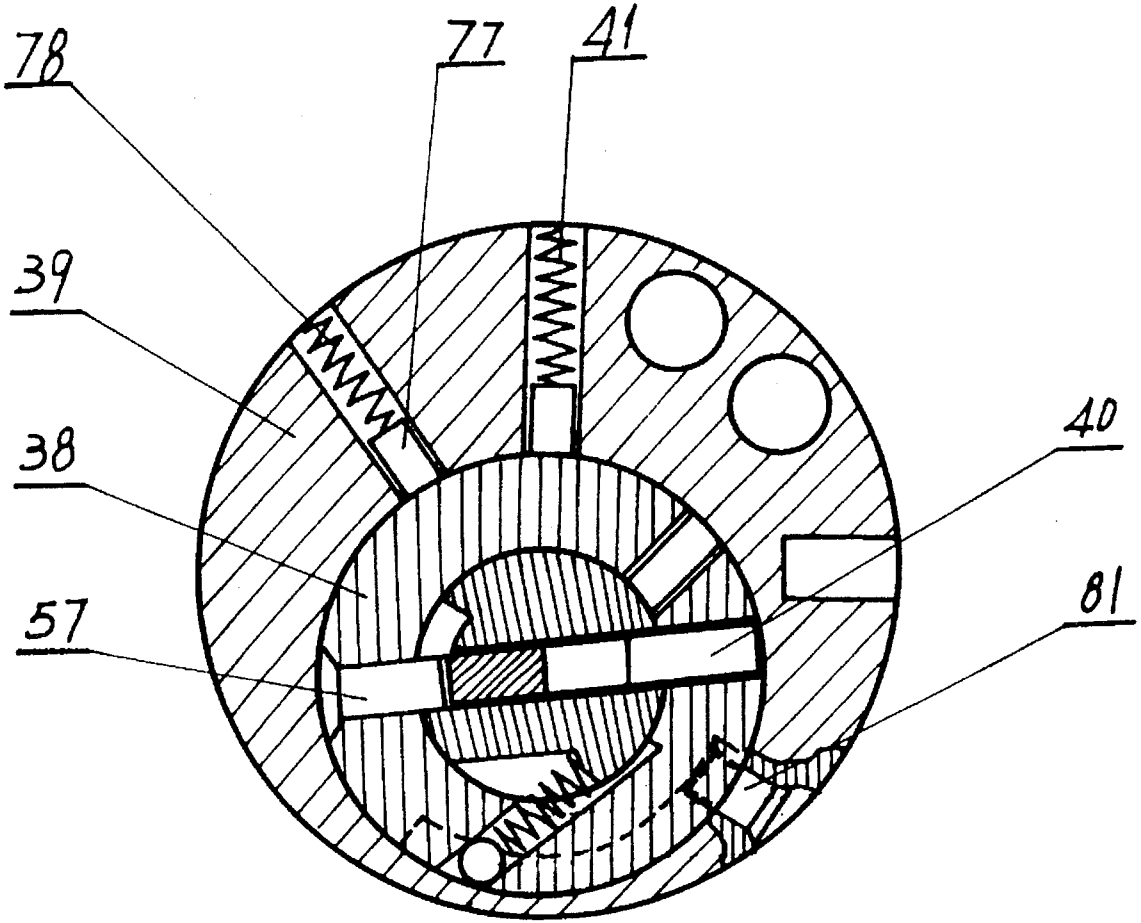
FIG. 16 is a schematic view of the fitting construction of the front lock cylinder with the key according to the invention when the key finishes the second operation.
Figure 20:
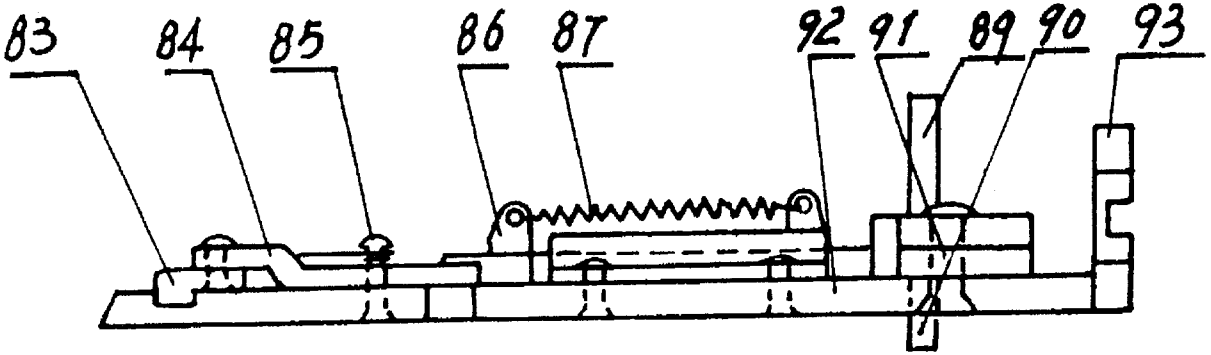
FIG. 20 is a side view of the interior construction of the lock tongue according to the invention.
Figure 21:
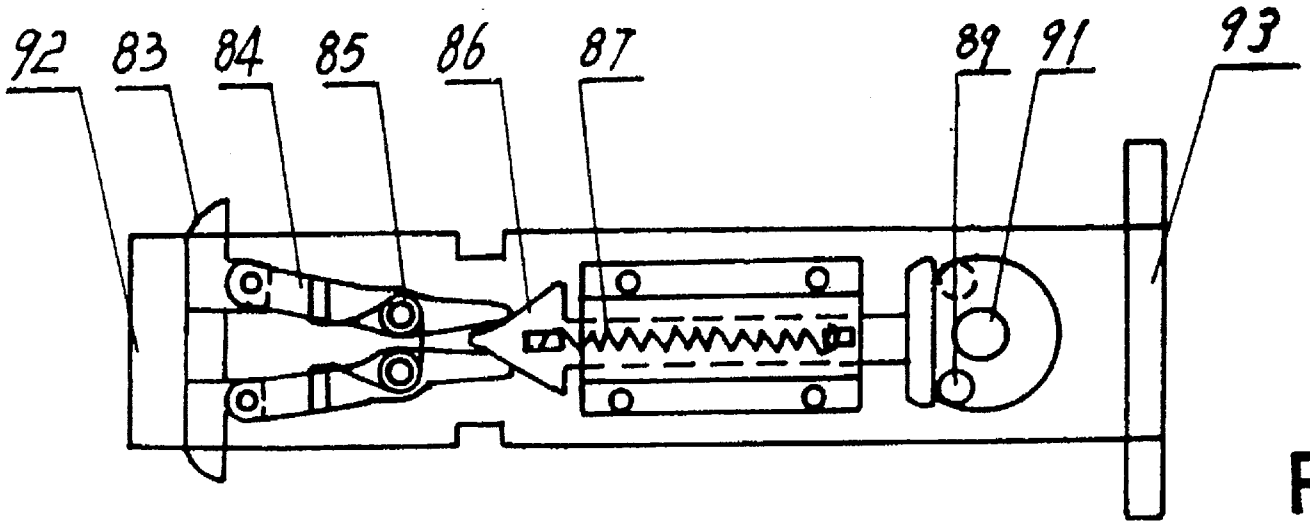
FIG. 21 is a schematic view of the interior construction of the lock tongue shown in FIG. 20.

Referring to FIG. 15, it can be seen that the further insert of the key 58 causes its second bit surface "C" to just fit with the second longitudinally arranged pin set 40, and at the same time the front longitudinal bit surface "E" of the key 58 to fit with the upper and lower pins 54, 55(FIG. 6), enabling that the front internal cylinder 37, middle cylinder 38 and the back internal cylinder 72 can rotate at the same time with relation to the front and back external cylinder respectively. By means of the positioning pin 81, which is fixed in the front external cylinder and guide the movement of the front middle cylinder, and whose construction is similar to the positioning pin 57 of the front internal cylinder 37, the cylinders 37, 38 and 72 turn a definite angle and cause the driving rod 32 secured on the back internal cylinder to turn, thus unlocking the lock.

Due to the fact that unlocking of the lock by the key provided by the present invention is required the fitting not only between the two bit surfaces D, C and the first and second longitudinally arranged pins 77, 40, but also between its front longitudinal bit surface E and the pin-set-like arrangement, the lock cylinder of the present invention has a very strict requirement to the key. Therefore, the lock with above cylinders is very difficult to unlock by other key substitutes. Furthermore, it is found, after calculation, that the number of the non-repeating shapes of the keys to fit with the lock cylinder of the invention during production at one time reaches 22280,000. Thus the possibility of production of the keys with the same shape can be avoided to the maximum extent. For the lock cylinder of the invention, it is difficult to be unlocked by the universal key, coincident key and repeating key.

Figure 7:
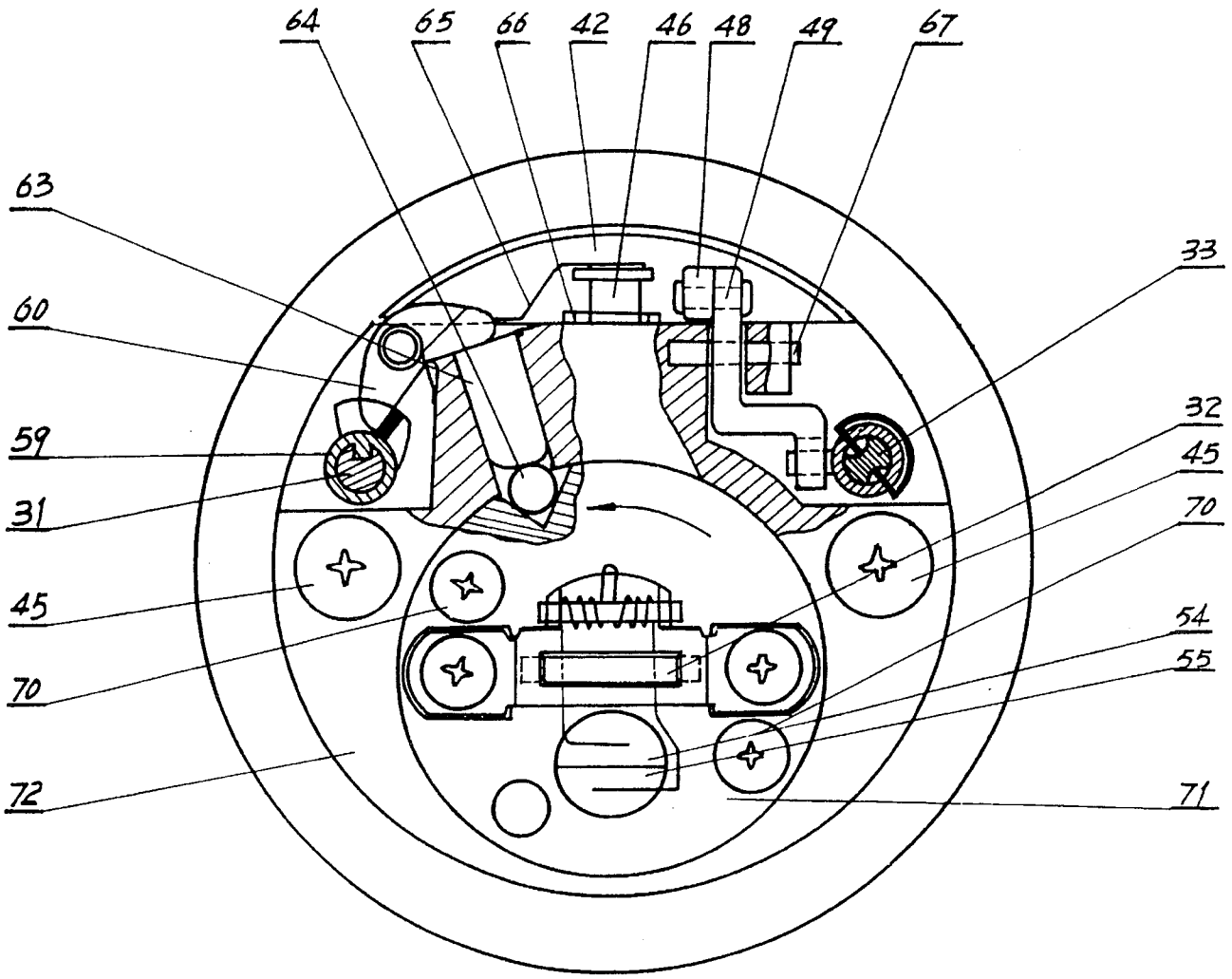
FIG. 7 is a rear view of the back lock cylinder according to the present invention showing the mechanism of the self-locking control mechanism on the cut surface of the back external cylinder and the moving section control mechanism.

As shown in FIGS. 6 and 7, on the upper end of each long pins 47 of the back lock cylinder is provided with the T-shape pins 46 pressed by the spring piece 65. The lower portion of each T-shape pins 46 is in the pin chamber of the back cylinder. When the destroying act on the long pins 47 from outside takes place, the T-shape pins 46 will drop down under the pressing force of the spring pieces 65 and the bottom surfaces of the heads of the pins 46 press the alarm sheets 66 to automatically switch on the electric alarm circuit. At the same time it will further protrude into the pin chamber of the back internal cylinder to prevent the back internal cylinder to rotate with respect to the back external cylinder.

Figure 9:
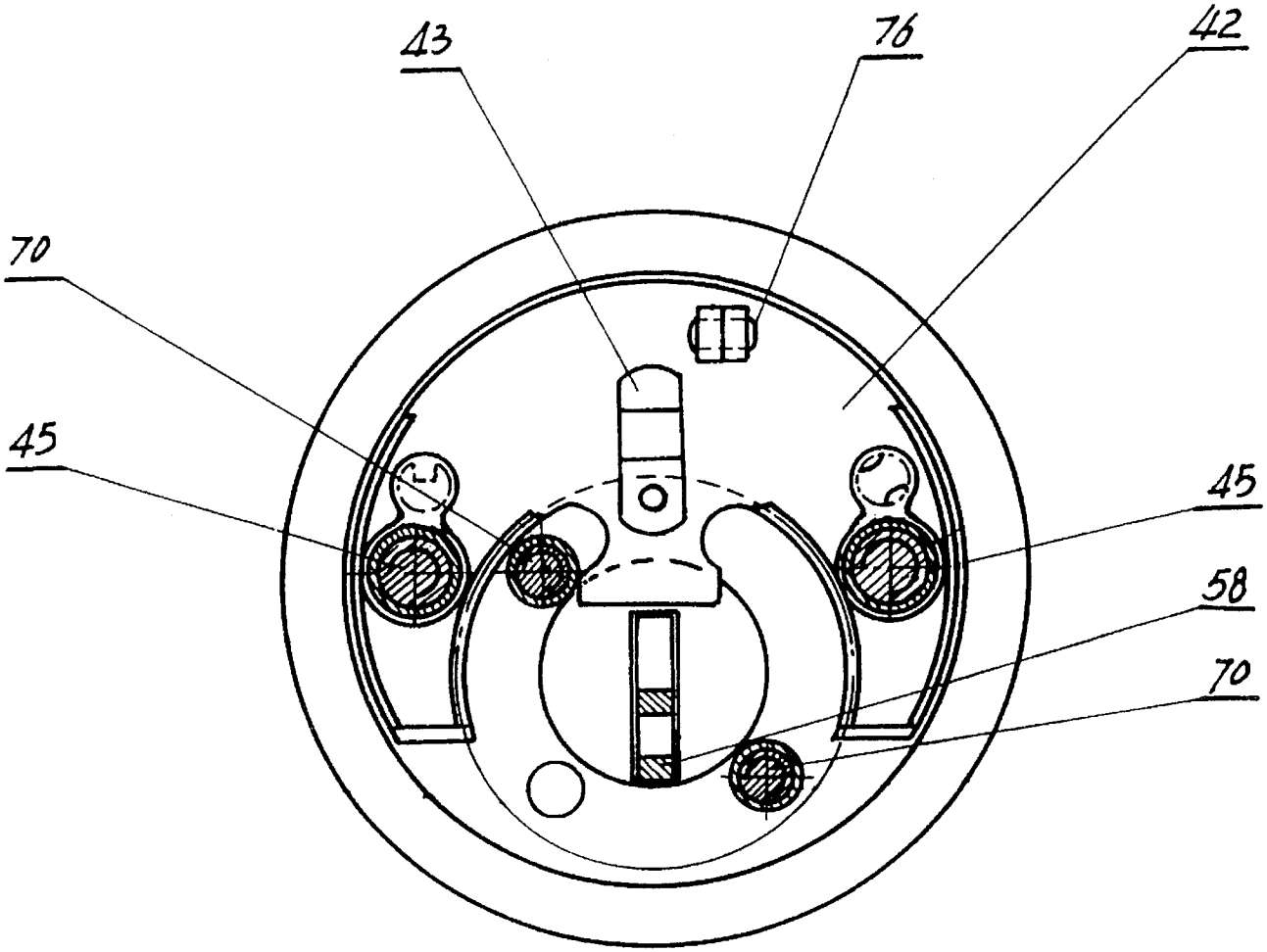
FIG. 9 is a front view of the self-locking moving plate according to the present invention showing its position in the lock cylinder.
Figure 11:
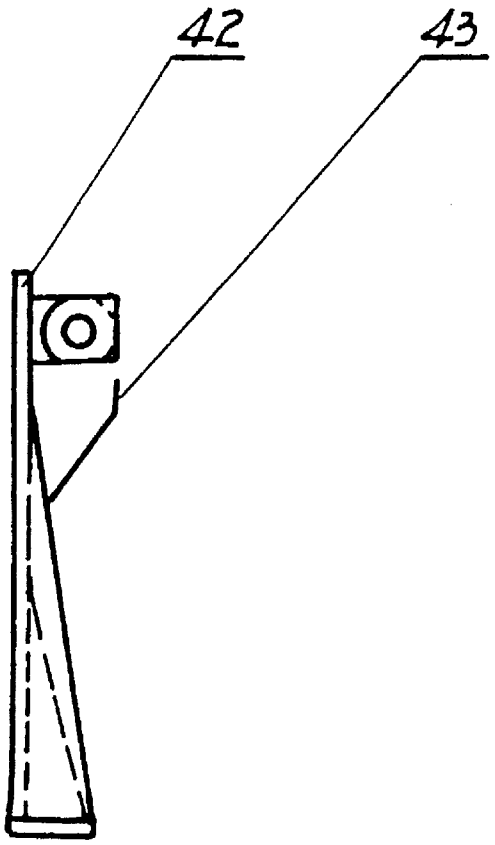
FIG. 11 is a side view of the self-locking moving plate of FIG. 10.
Figure 10:
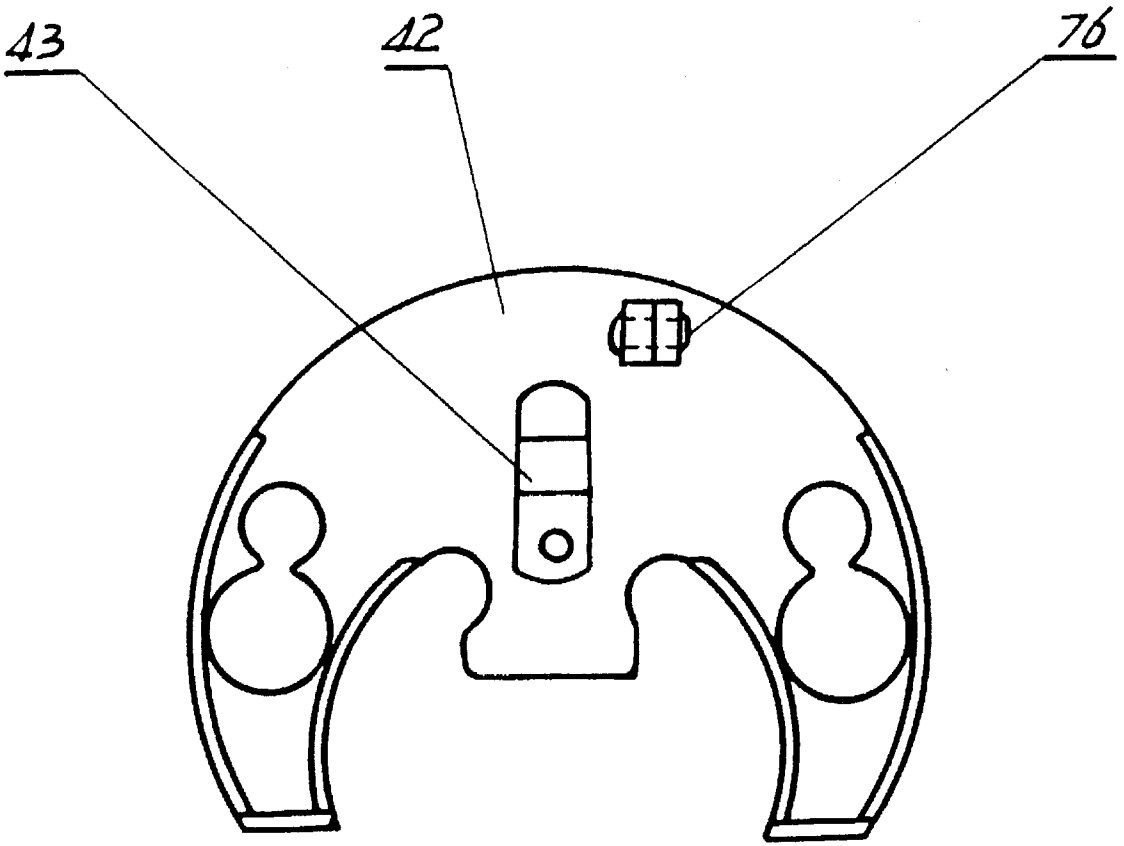
FIG. 10 is a main view of the self-locking moving plate of the invention.

Further, as shown in FIGS. 6 and 10, a self-locking moving plate 42 is provided between the front and back lock cylinder. It fits with a cross connecting rod 48 and a longitudinal connecting rod 49. As shown in FIGS. 9–11, the self-locking moving plate 42 is a plate piece. The bolts 45 used to connected rigidly the front and back external lock cylinders pass through the holes on its both sides and position the plate 42 between the front and back lock cylinders, but not disturbing the rotation of the middle cylinder 38 of the front lock cylinder. The self-locking moving plate 42 abuts against the rear surface of the front lock cylinder by the spring piece 43. The upper part of the self-locking moving plate 42 is hinged to one end of the cross connecting rod 48, and the other end of the cross connecting rod 48 is hinged to the upper end of the longitudinal connecting rod 49 (FIG. 7). The middle part of the longitudinal connecting rod 49 is hinged to the back lock cylinder by a pivot 67, and the lower end of the rod 48 is fitted with the self-locking control rod 33. The self-locking control rod 33 is secured with the freedom of the axial movement on the back external cylinder 72 of the lock cylinder portion and extends backward to press against one end of the self-locking control pin 125 of the lock body (its mechanism will be described in the below description). When the lock cylinder is in its no-working state, the spring 43 makes the plate 42 locate in the idle state. Once the lock cylinder is damaged by impact, for example the lock cylinder portion is drilled from outside, then the front lock cylinder will, apply impact to the plate 42 causing it to move toward the back cylinder. As a result, the upper portion of the plate 42 pushes the cross connecting bar 48 connected therewith. Therefore, the longitudinal connecting bar 49 rotates around the pivot 67, causing the self-locking control rod 33 to move to the front lock cylinder (to the left in FIG. 6). Thus the self-locking control pin 125 is released and the self-locking control mechanism of the lock body works to complete self-locking operation. Furthermore, in case that the lock cylinder is digged out, the self-locking control rod 33 will be removed and the above mentioned self-locking operation also takes place.

Therefore, in spite of any destroying act, once the self-locking moving plate 42 moves toward .the back lock cylinder or the lower end of the longitudinal rod 49 moves toward the front lock cylinder, the fitting between the self-locking control rod 33 and the self-locking pin 125 will cause the self-locking control mechanism inside the lock body to operate.

As shown in FIG. 7, an moving section control mechanism is provided on the rear side of the back lock cylinder and arranged parallel to the self-locking control mechanism at the right (see FIG. 7). The mechanism includes a moving section control rod 31 which extends into the lock body to control the position of a moving section 132 inside the lock body, a V-shape element 60, a ball 64 and a bar 63. As shown in FIG. 7, a V-shape groove is provided in the periphery of the back internal cylinder 71. The ball 64 is located in the V-shape groove and corresponding to the said V-shape groove, a long hole is provided in the back external cylinder 72. The bar 63 is slidably arranged in the long hole, one end of which presses the external spherical surface of the ball 64 located in the V-shape groove and the other end of extends out therefrom. The angled portion of the V-shape element 60 is hinged to the back external cylinder 72 and presses one end of the bar 63 which extends from the long hole under the pressing force of a torsional spring. The other end of the V-shape element 60 is fitted with a fitting portion extending outward from the periphery of the external bush 59 of the rod 31. The moving section control rod 31 is fitted rigidly with the external bush 59. When the lock cylinder portion is turned by the key 58, the back internal lock cylinder 71 also turns, pushing the ball 64 out of the V-shape groove. With the help of the ball 64, the bar 63 moves upward, causing the V-shape element 60 to rotate counter clockwise (FIG. 7), so that the other end of the V-shape element 60 drives the external bush 59 to rotate, causing the moving section control rod 31 to rotate, whereby the end of the moving section rod 31 protruding into the lock body rotates the moving section 132 hinged on the bottom plate of the lock body to release the external moving head 130. When the lock cylinder is not rotated, the end of the moving rod 31 can not rotate the moving section 132, causing the moving section 132 to engage with the external moving head 130, so that the external moving head 130 will forever be in the locking state, thus eliminating the danger of unlocking the lock by directly rotating the external moving head 130 through drilling the driving rod 32 performed by a poor behaving person from outside.

Figure 22:
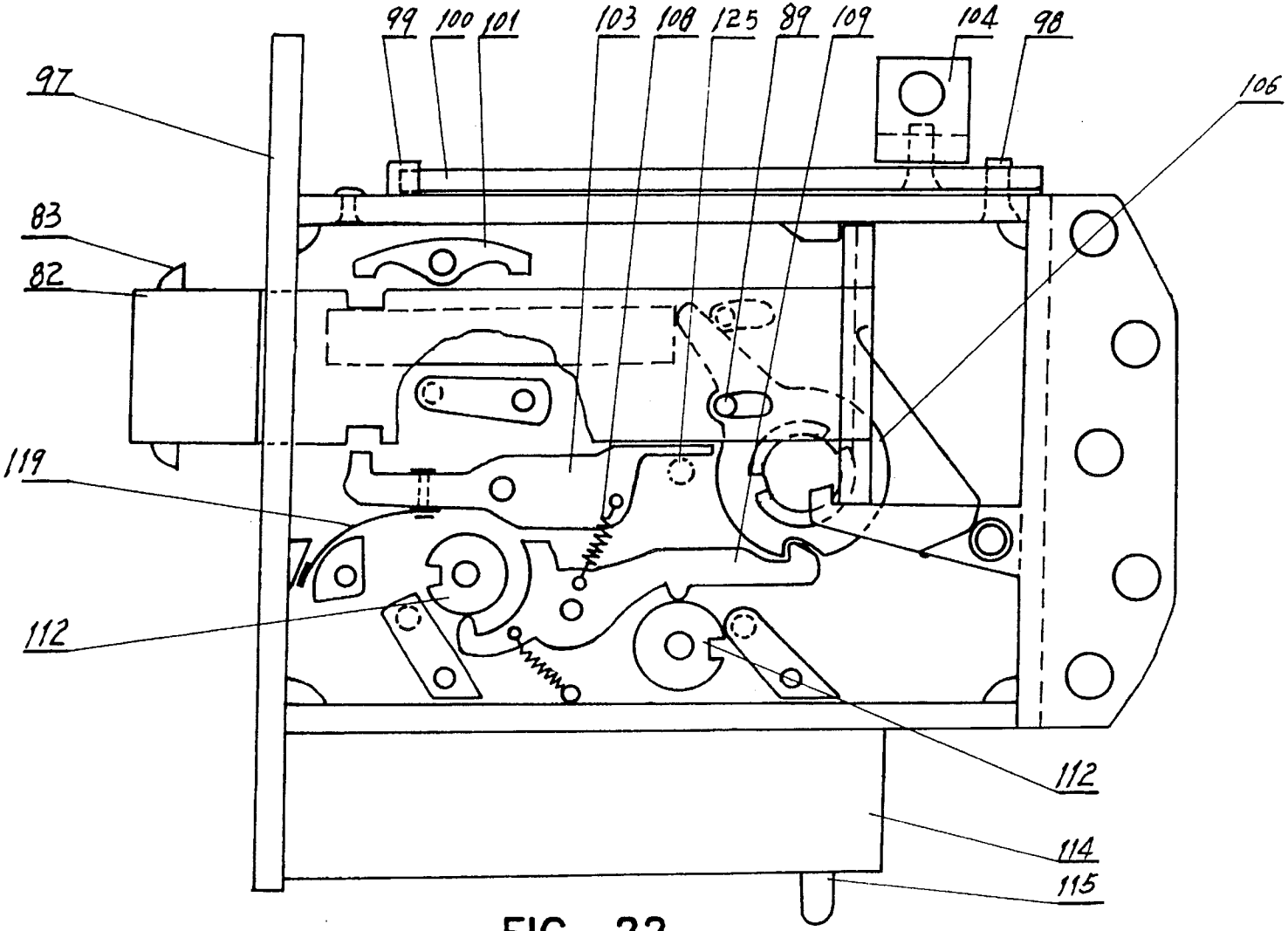
FIG. 22 is a schematic view of the interior construction of the lock body according to the present invention.
Figure 23B:
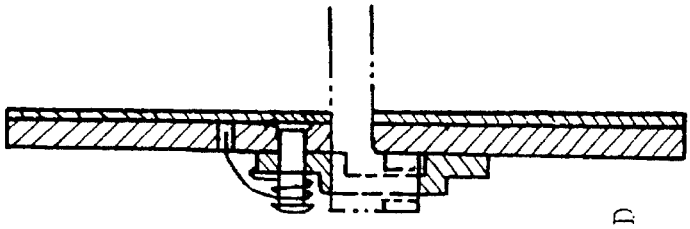
FIG. 23B is a cross sectional view along the XXIII—XXIII line of FIG. 23A.
Figure 23C:
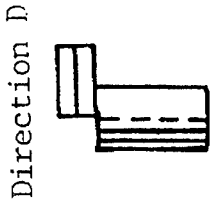
FIG. 23C is a view taken in the direction of arrow D in FIG. 23A.
Figure 23A:
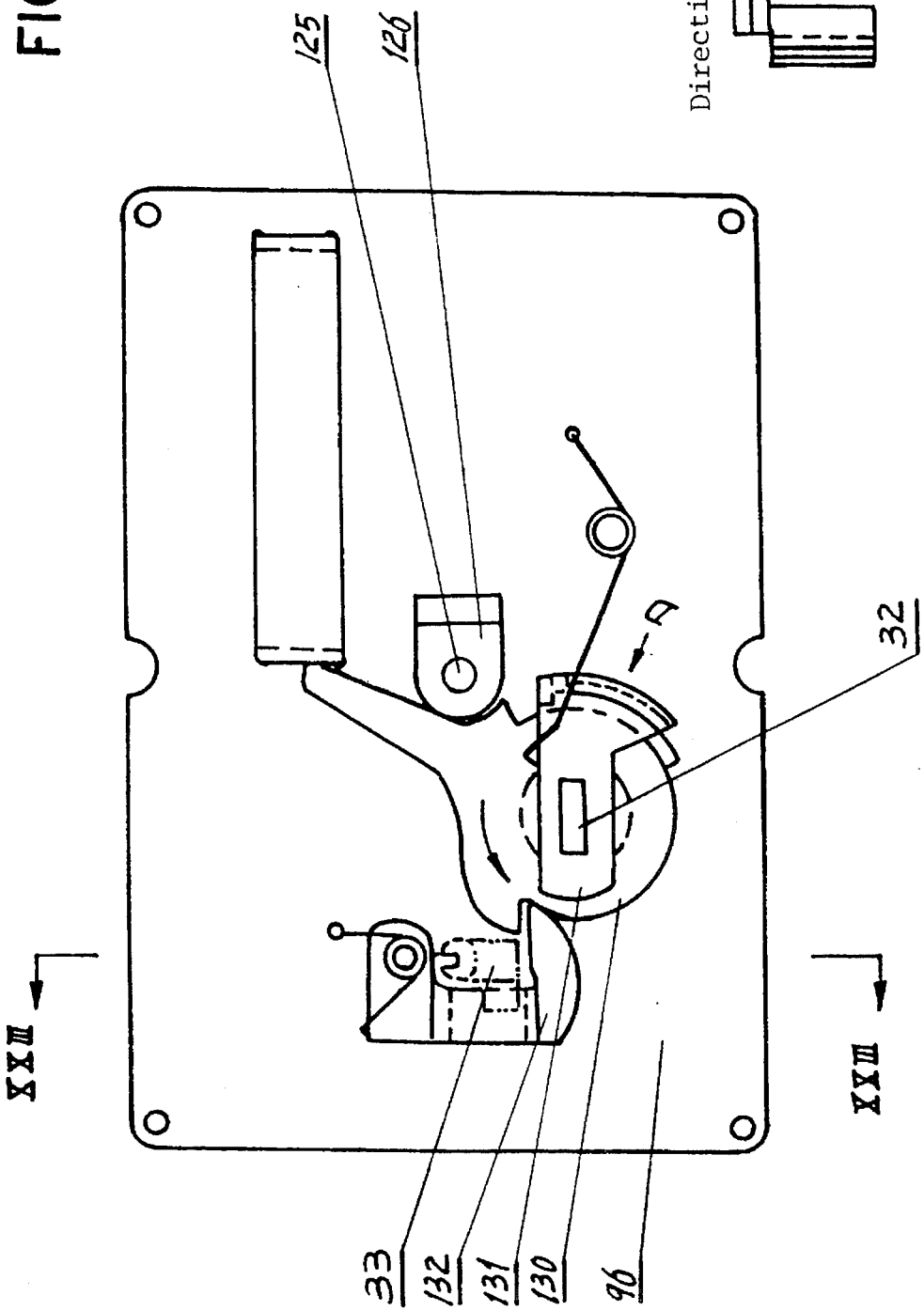
FIG. 23A is a main view of bottom plate construction of the lock body according to the present invention.
Figure 24:
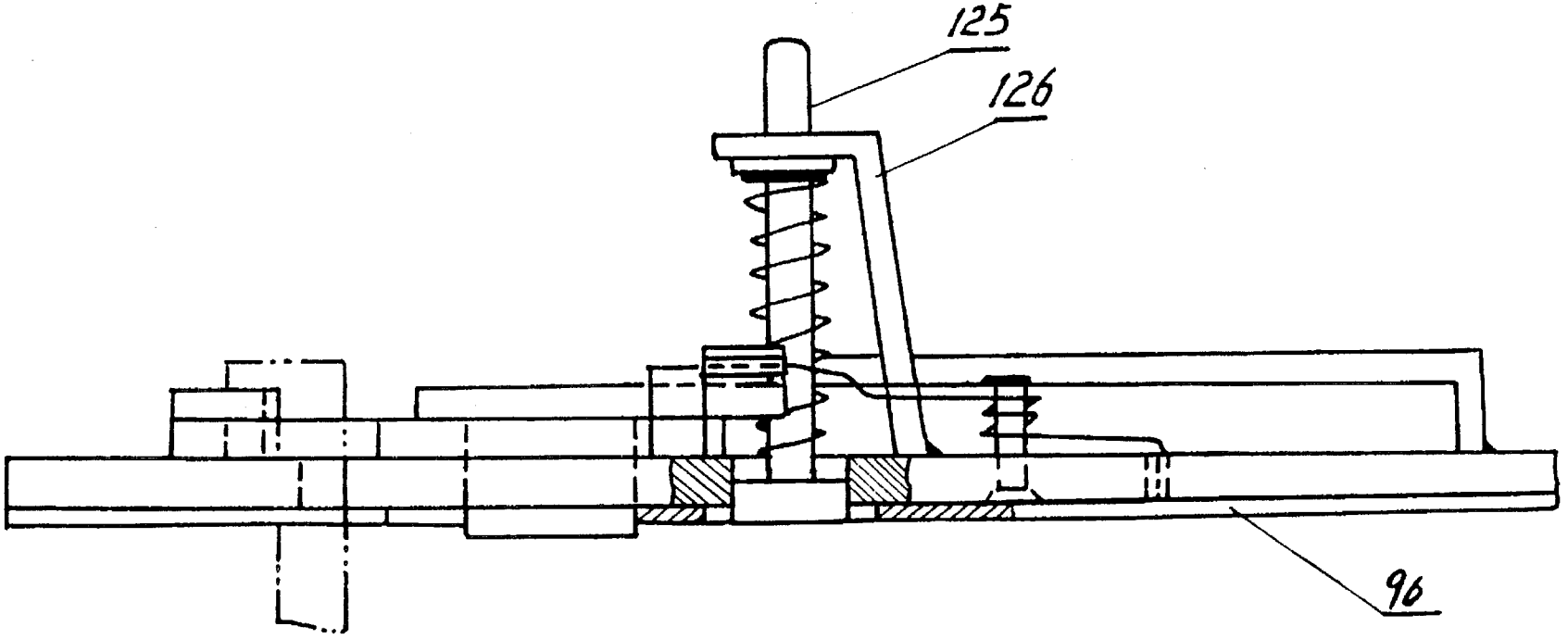
FIG. 24 is a schematic front view of the bottom plate construction of the lock body according to the invention.

The lock body portion of the invention is shown in FIGS. 22–24, in which FIGS. 23A and 23B shows the interior construction of the bottom plate 96 of the lock body. The external moving head 130 is hinged to the bottom plate 96. A hole is provided in the middle part of the plate 96 for the driving rod 32 to pass through. An external moving head control wheel 131 is located in front of the external moving head 130. The middle part of wheel 131 is secured to one end of the driving rod 32 protruding in the lock body. A projection is formed at one side of the external moving head control wheel 131 and extends to the head 130. The upper end of the moving head 130 is used for moving the upper projection 89 of the lock tongue 82 to control the forward and backward movement of the lock tongue 82. Beside one side of the lower part of the external moving head 30 is the external moving section 132, the upper end of which is hinged to the bottom plate 96. The lower part of the moving section 132 clutches the external moving head 130 to prevent it from rotation along the direction of unlocking of the lock. The moving section control rod 31 of the lock cylinder portion passes through from the bottom plate 96 and the gripping fingers formed at its end to fit with the middle part of the external moving section 132. When the lock cylinder is rotated by the key 58, the driving rod 32 and the moving section control rod 31 rotate simultaneously in opposite directions. Firstly the moving section rod 31 rotates the external moving section 132 clockwise causing the moving section 132 to release the external moving head 130. Simultaneously the driving piece 32 rotates the external moving head control wheel 131. After the external moving head control wheel 131 has rotated a definite angle, its projection fits with the external moving head 130, thus causing the external moving head 130 to rotate with the driving piece 32. As a result, the external moving head 130 rotates counter clockwise to release the lock tongue, i.e. the lock tongue moves out from the tongue chamber and sets into the lock body to unlock the lock.

On the other side of the external moving head 130 (FIG. 23A), the self-locking control pin 125 is provided. One end of the said control pin 125 is fitted with the control pin frame 126 and its other end protrudes into a through hole formed on the bottom plate 96. After the lock has been fixed to the door, the self-locking control rod 33 extending out from the lock cylinder protrudes into the bottom plate and presses the exterior end surface of the self-locking control pin 125 which extends to the bottom plate. The other end of the self-locking control pin 125 is used to protrude into the lock body and fix the self-locking element 103 in the lock body. The function of the self-locking control pin 25 will be described hereafter.

FIG. 22 shows the interior construction of the lock body portion where the lock tongue 82 is located in the upper part of the body. Two projections extends laterally and outwardly from the front and back sides of the lock tongue 82: the upper projection 89 and the lower projection 90. The external moving head 130 is fitted with the upper projection 89, and an internal moving head 106 is fitted with the lower projection 90. The heads 130 and 106 are used for the forward and backward movement of the lock tongue by operation of the key and the interior handle 136 of the lock. An M-shape element 101 is provided in the upper part of the lock body with its middle part hinged to the interior wall of the lock body. Corresponding to the M-shape element 101, a handle 135 is provided in the outer surface of the lock body. The handle 135 controls the pivot 102 of the M-shape element allowing the M-shape element to rotate clockwise or counter clockwise. When the lock tongue 82 is inserted in the tongue chamber and has the lock in the locking state, the M-shape element handle 135 can be operated in the interior of the room. One foot of the M-shape element 101 is inserted in the corresponding recess of the lock tongue to lock the tongue, thus the lock can not be unlocked from outside by the key.

The self-locking element 103 is provided below the lock tongue 82. Its middle portion is hinged to the interior side of the lock body, A protrusion extends upwardly from the left end of the self-locking element 103. The right end of the element 103 is fitted with one end of the self-locking control pin 125 extending out from the self-locking control pin frame 126. In normal state, the self-locking element 103 does not work. When a destroyer damages the lock cylinder from the exterior of the door causing the self-locking moving plate 42 to shift, the upper part of the plate 42 will move the cross connecting rod 48 and the longitudinal connecting rod 49 causing the self-locking control rod 33 to move to the back lock cylinder. The self-locking control pin 125 will also move toward the lock cylinder by its spring 128. Thus due to the reduction of the length inside the lock body, the self-locking control pin 125 releases the end of the self-locking element 103. The left end of the self-locking head 103 is raised by the spring 108 and the projection formed thereon enters the corresponding recess of the lock tongue, so that the lock tongue 82 is fixed from the interior of the lock body. Under such condition, the lock can not be unlocked even when the driving rod 32 is rotated, thus preventing illegal stealing act by destroying of the lock cylinder from outside. Furthermore, the spring alarm piece 119 installed at the self-locking element 103 will contact the alarm contact piece 118 fixed on the lock body to switch on the alarm electrical circuit.

Also as shown in FIG. 22, a man-operating internal lock mechanism controlled by the internal lock secret code disks 137 is provided in the lower part of the lock body. The said mechanism contains two secret code plates 112 and a contact arm 109 which fits with bottom disks 112. Each bottom disk 112 is rigidly connected a secret code disk 137 through a shaft. A recess is formed in the periphery of each bottom disk 112. Protrusions corresponding to the recess in the above mentioned bottom disks are provided on the contact arm 109. Besides above protrusions, there is another protrusion formed at the right end of the arm 109 and used for fitting with the pit in the internal moving head 106. When the numbers of the secret code plate 137 are operated correctly, two protrusions of the contact arm 9 enter into the recesses of the bottom disks 112, whereby the projection in the right end of the contact arm 109 is disconnected from the pit in the periphery of the internal moving head 106, enabling the internal moving head handle 136 can rotate the internal moving head 106, so that the lock can be unlocked from the interior of the room. If the secret code is in mess condition, then the protrusions of the arm 109 is connected with the recesses of the bottom disks 112, and the projections at its right end fixes the internal moving head 106. Therefore, even when the person who does not know the secret code enters the room, the lock can not be unlocked from the interior of the room.

Figure 1:
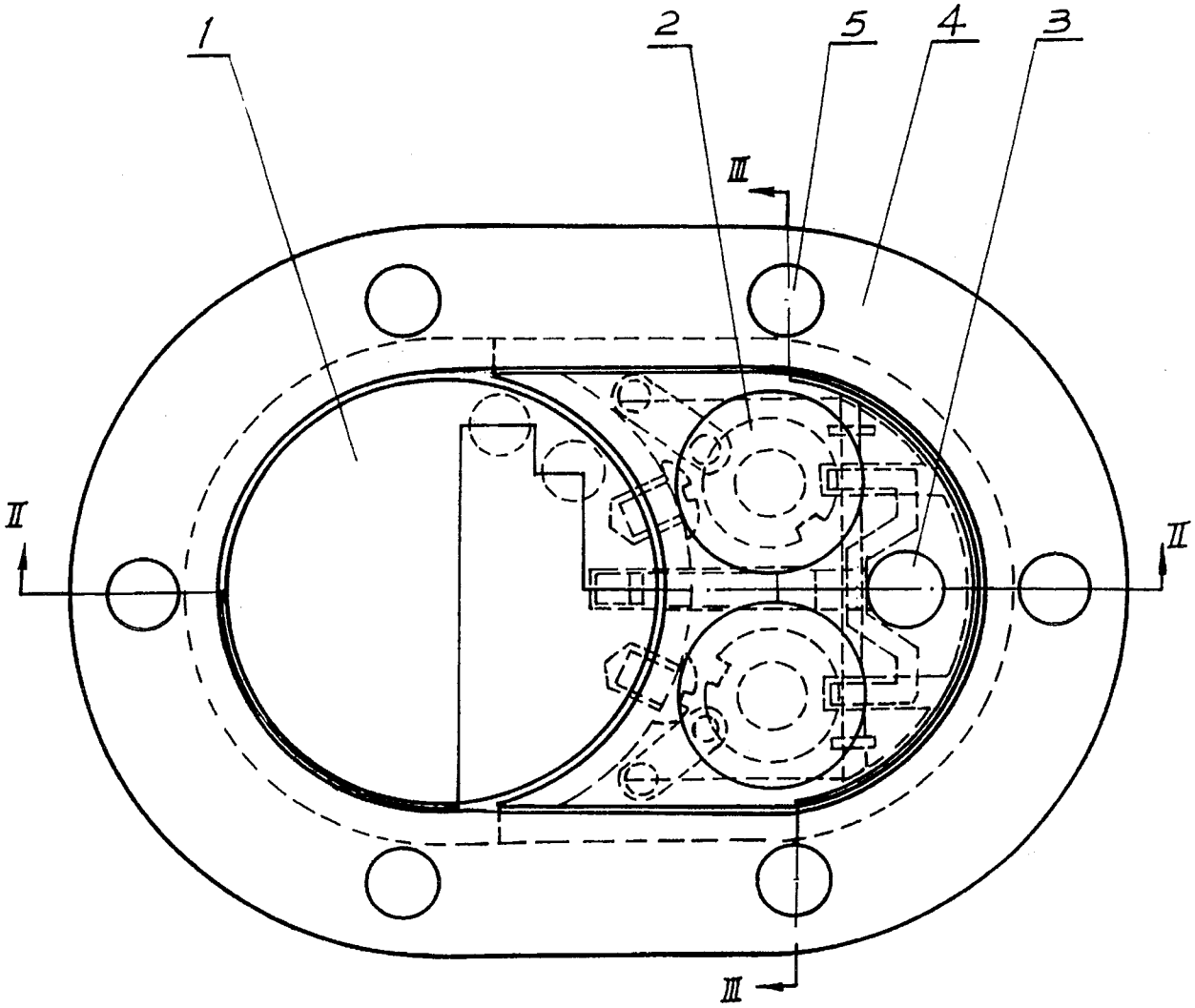
FIG. 1 is a main view of the external lock portion of the present invention.
Figure 2:
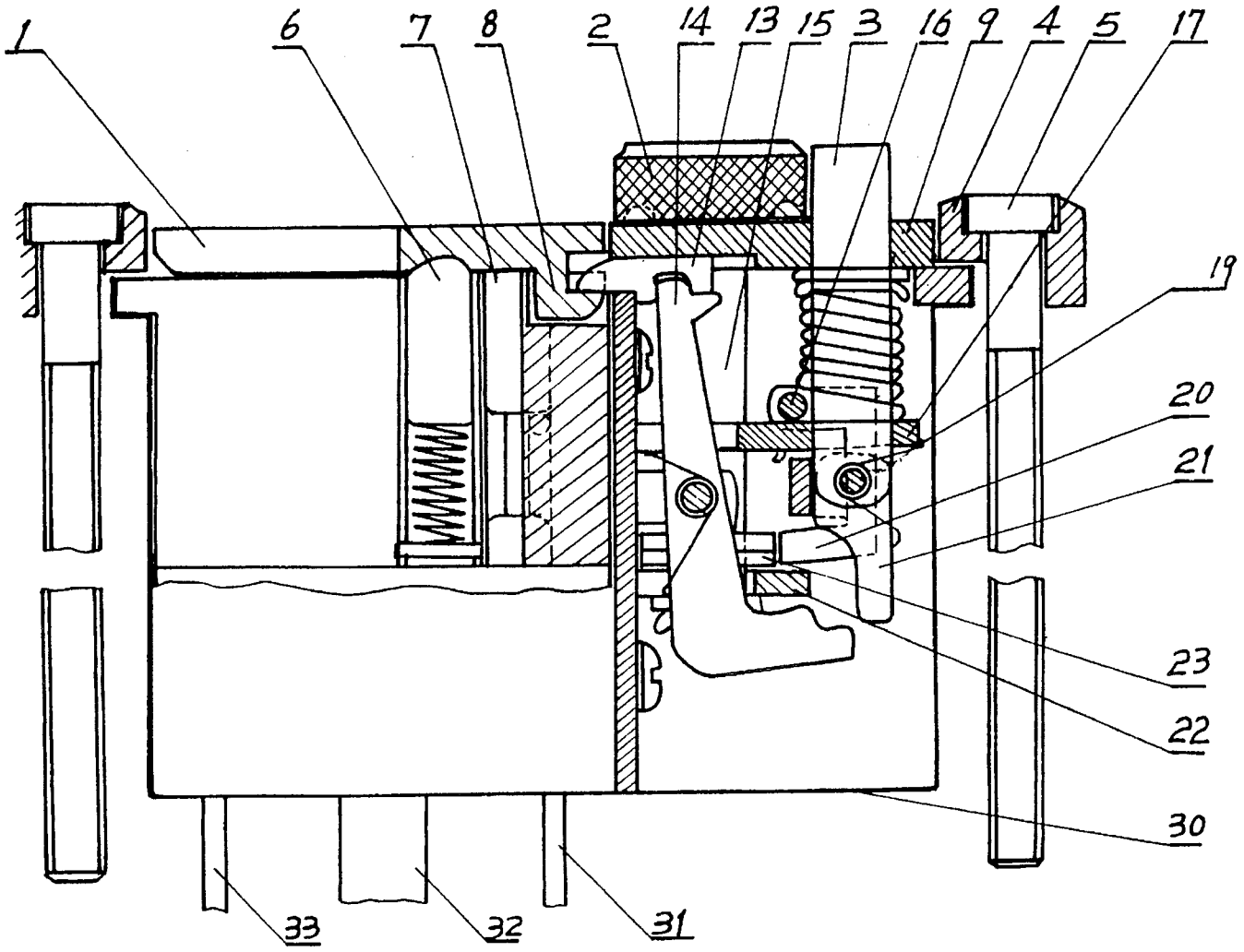
FIG. 2 is a cross section view along the II—II line of FIG. 1.
Figure 3:
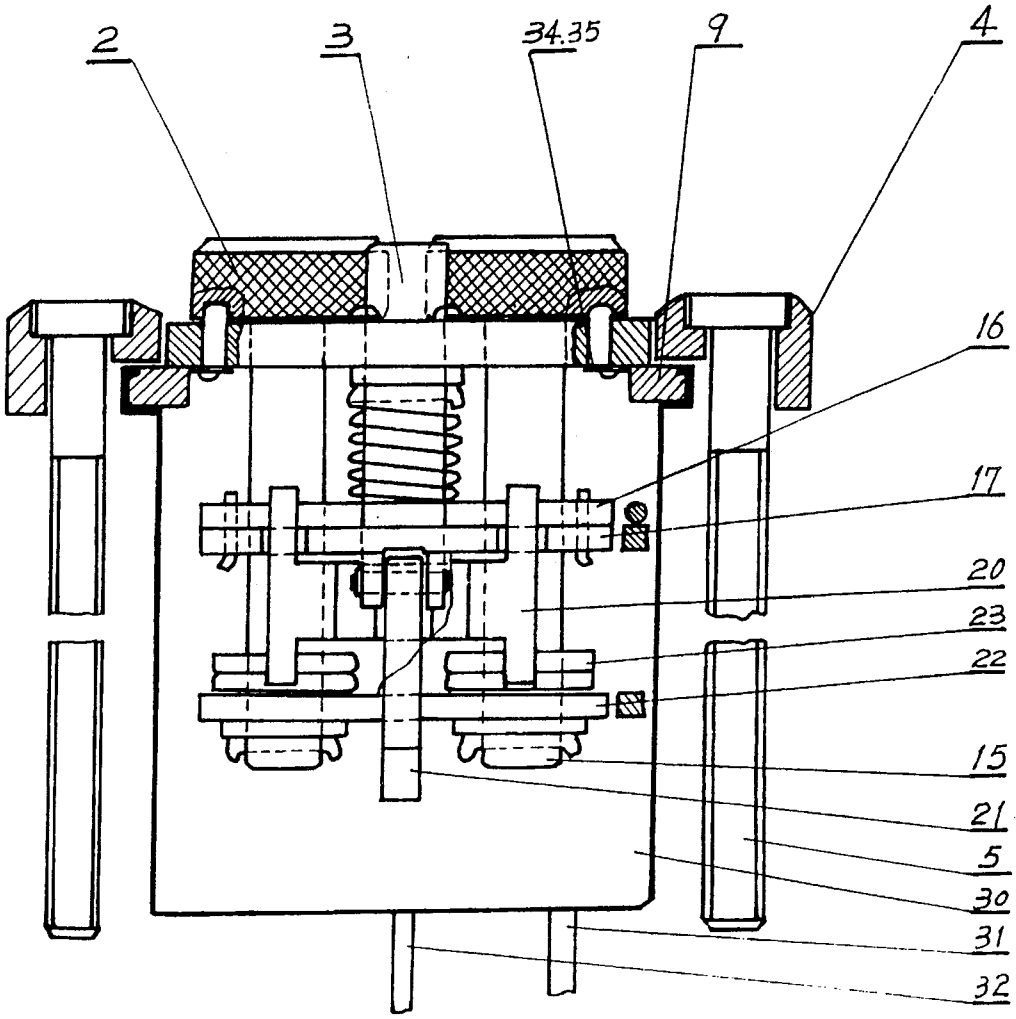
FIG. 3 is a cross section view along the III—III line of FIG. 1 showing the close door control mechanism of the external lock portion according to the present invention.
Figure 4:
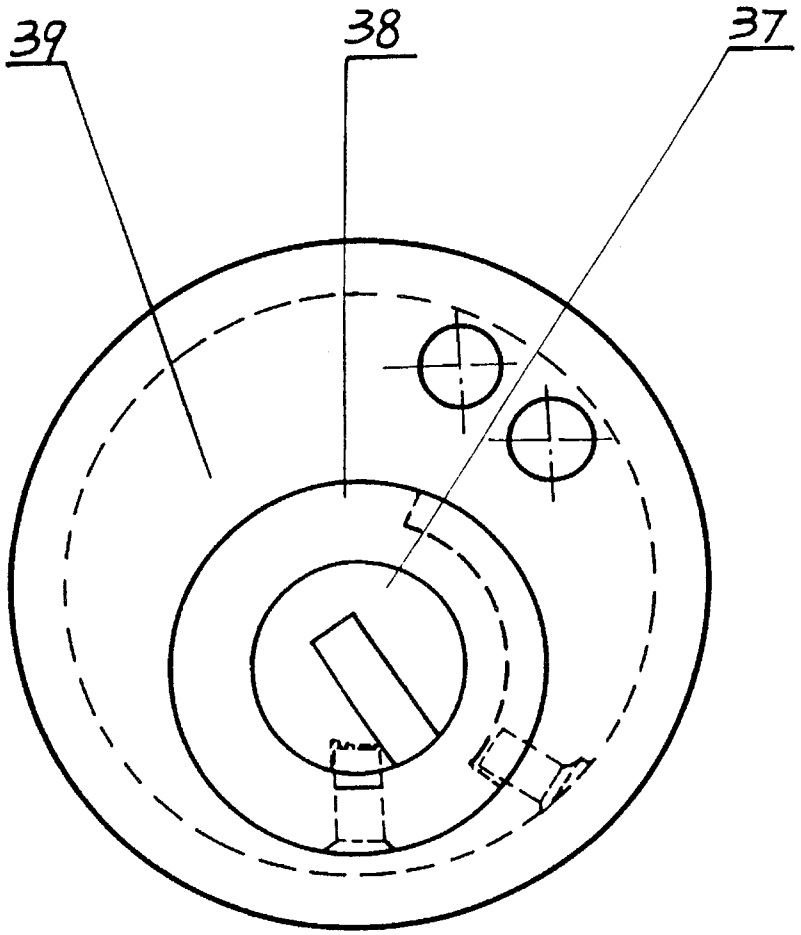
FIG. 4 is a schematic view of the lock cylinder surface.

FIGS. 1–3 show the second embodiment of the present invention, the difference between this embodiment and above is in that a external lock portion is provided. The lock cylinder portion and the lock body portion in this embodiment are the same as that of the above mentioned embodiment, and description of them will be omitted.

The construction of the external lock portion can be referred to FIGS. 1–3. As shown in FIG. 1, the external lock portion includes a housing 30, and a pressing ring 4 which is fastened by bolts 5 to the door is provided along the outer periphery of the housing 30. A close door 1 is situated on the left of the housing 30, and beside the door 1 is the close door control mechanism. The close door 1 is a circular piece type door which defines a close space together with the left portion of the housing 30 for containing the lock cylinder portion. When the lock cylinder portion is in the space, the close door 1 controls the closing and opening of the key hole. A rod 7 is formed on the door 1 and extends into the lock cylinder portion. A neck portion is formed at the lower portion of the rod 7 and fits with a pin, whereby, the rod 7 can move upwardly and downwardly with relation to the lock cylinder within a definite range and also be used as a pivot of the close door 1. Around the rod 7, the door 1 can be rotated with respect to the lock cylinder portion. A spring and bar mechanism 6 which is arranged in the lock cylinder and applies a force on the door 1 is provided at the adjacency of the rod 7. A close door lock hook 8 used for fitting with the close door lock head 13 in the close door control mechanism is formed on the close door 1.

The close door control mechanism includes two secret code plate elements and a knob 3. A secret code disk 2 is formed the upper part of each secret code plate element, the lower end of which is-formed a bottom plate 23. Between the disk 2 and the disk 23 is the shaft 15 which is rotatably fitted with the lower supporting plate 22 situated inside the housing 30. Numbers are printed on each secret code disk 2. The secret code disk 2 is arranged on the upper surface of an external plate 9. A recess is provided on th periphery of each bottom plate 23 (as shown in FIG. 1 by the dotted line). Referring to FIG. 2, a M-shape displacement element 20 is hinged at the upper supporting plate 17 of the housing 30 with its two lower feet pressing the peripheries of the bottom disks 23. The knob 3 is supported on the upper supporting plate 17 by a spring and can move upwardly and downwardly. One end of the knob 3 extends out from the upper surface of the external plate 9 with its other end hinged to a knob executing element 21. The knob executing element 21 is pressed on the rear part of the displacement element 20 by a torsional spring 19 and forces two lower feet of the displacement element 20 to tightly press the peripheries of the bottom disks 23. A L-shape operating element 14 hinged at its middle part is provided between two secret code plate elements, whose upper end is fitted with the close door head 13, whose lower end is bent toward the knob executing element 21. When the close door 1 is in the close position, it presses down the spring and the bar mechanism 6. The lock head 13 which can move leftward and rightward is fitted with the close door lock hook 8 formed on the close door 1. At this time, the lower feet of the displacement element 20 press the exterior peripheries of the bottom disks 23 and the knob executing element 21 is separated from the lower end of the operating element 14 in the longitudinal direction. Thus in spite of the knob 3 pressed down, due to the fact that the knob executing element 21 is not able to contact the operating element 14, the knob can not work anymore. When the close door 1 is desired to open, first, turning the secret code disk elements so that the recess on the bottom disk 23 is oriented correctly to the position of lower feet of the displacement element 20. At this time, the displacement element 20 will rotate around its pivot causing its bottom feet to insert into the above mentioned recesses under the force of the torsion spring 19, and simultaneously, the knob executing element 21 which is pressed on the displacement element 20 to rotate an angle around the pivot reaching the position where the lower end of the operating element 14 is just thereunder. Under such condition, when the knob 3 is pressed down, the operating element 14 will be turned clockwise by pressing action of the knob executing element 21. Thus, the lock head 13 will be forced to disconnect from the fitting with the lock hook 8 and the close door 1 will be released. The released close door will move upwardly a distance by the spring and bar mechanism 6. After that, the user may rotate the close door to one side so that the key hole can be exposed. When it is necessary to close the lock hole, first, turning the secret code disks 2 so that the bottom disks 23 draw the lower feet of the displacement element 20 out of the recesses, and then turning the close door to the initial position, pressing down to have the lock hook 8 to fit the lock head 13.

Additionally, clear marks may be provided on the upper surface of each secret code disk element and the upper surface of the external plate 9, so that the user can correctly orient the secret code disks 2 by means of the mark and open the close door. At the same time, in order to use it in the case of lacking brightness, a recess may provided on the bottom surface of each secret code disk 2. Each recess is fitted with a pin 34 located inside the external plate 9 and pressed by a spring piece, so that the user can correctly orient the secret code plate elements by sensation of his hand and open the close door 1.

The destroying action applied to the lock hole from outside intentionally or unintentionally can be effectively prevented by providing the external lock portion closing the key hole in the case of not using it.

The mechanism provided by the invention can be fitted with the prior lock tongue, but in the third embodiments of the present invention, the lock tongue shown in FIGS. 17–21 which is an anti-moving lock tongue may be used. In this embodiment, other parts except the lock tongue is the same as the first embodiment and the description thereof will be omitted. As shown in FIGS. 17–21, the bottom plate 92 of the lock tongue, the end plate 93 of the lock tongue and the surface plate 95 of the lock tongue are welded rigidly together. A cross groove is formed in the front part of the bottom plate 92, two L-shape anti-moving heads 83 are slidably located in the cross groove. The front end of each anti-moving head can extend out from the lock tongue. Anti-moving head levers 84 are pivotably connected with each of the rear ends of the anti-moving heads 83 respectively. The middle parts of two anti-moving head levers are hinged by a pivot 85 to the bottom plate 92 and their rear parts are fitted with a cone pulling element 86. The rear end of the pulling element 86 is fitted with an upper moving wheel and a lower moving wheel, which are in circular segment shapes and hinged by the same pivot 91. The upper and lower projections 89 and 90 are formed respectively on the sides of the moving wheels. In the normal state, the anti-moving heads 83 extend out of two sides of the lock tongue 82. When the lock tongue 82 enters the lock tongue chamber, the heads 83 can be pressed down by the edge of the tongue chamber into the lock tongue firstly and then spring out to fit with the side walls of the tongue chamber. Thus the lock tongue can not be pushed back even when the lock tongue is illegally pushed by the external force from outside of the door. In this normal condition, when the lock is unlocked with for example the key, the external moving head 130 pushes the upper moving wheel through the upper moving projection 89 causing the wheel to turn counter clockwise. Rotation of the upper moving wheel forces the pulling element 86 to move forward opposite the force of the spring 87 and has the head of the element 86 extending further between two anti-moving head levers 84, moving apart the rear parts of two levers and at the same time making the front parts of the levers move one towards another. Thus the anti-moving heads 83 are drawn into the lock tongue 82. Then because the upper moving wheel has turned to its end position, further driving the upper projection 89 will force the lock tongue to return the lock body. The lower moving wheel with the projection 90 can be operated by the head 106 similarly.

In order to guarantee the stiffness of the lock tongue, a reinforced steel plate 94 can be welded to the transfer spot of the inclined surface and the plane surface of the lock tongue surface plate 95. Thus the strength of the lock tongue is increased.

According the fourth embodiment of the invention, an anti-invading mechanism may also be provided in the lock having the construction of the first embodiment invention. As shown in FIGS. 25, 27, 28, 29, a moving bolt bush 114 is secured under the lock body. A moving bolt 139 with its handle 115 slidably extends in the bush 114, and a neck portion is formed at the head of the said moving bolt 139. An anti-invading plate 141 is provided under the lock tongue chamber corresponding to the position of the moving bolt 139. The plate 141 is pivotably connected with a short element 143 and can rotate one relative to the other. The short element 143 is hinged to the lock tongue chamber. Therefore, the plate 141 not only can move front and backward with relation to the short element 143. but also can rotate together with the element 143 upwardly and downwardly with relation to the lock tongue chamber. A torsional spring 144 is located at the hinged spot of the lock tongue chamber and the element 143 and used for guaranteeing the plate 141 to stay at a positioning base 159 in its no-working state. The element 143 is connected with one end of a cross bar 155. The other end of the cross bar 155 is hinged to middle portion of the alarm plate 153, one end of which is hinged to the tongue chamber. The other end of the alarm plate 153 is arranged to have a certain space from an alarm contact sheet 158 secured on the lock tongue chamber. The alarm plate 153 and the alarm contact sheet 158 are respectively connected with the alarm electric circuit. In practice, The moving bolt 139 can be drawn out from the bush 114 by pushing the handle 115, and be inserted into the plate 141. In the case of the door is opened, a person from outside can only force the moving bolt 139 to cause the plate 141 rotate with respect to the element 143 and together with the element 143 to rotate with respect to the tongue chamber, causing the door ajar while he pushes the door. If he continues to push the door with force, the alarm plate 153 will contact the alarm contact piece 158 to switch on the alarm circuit.

Figure 25:
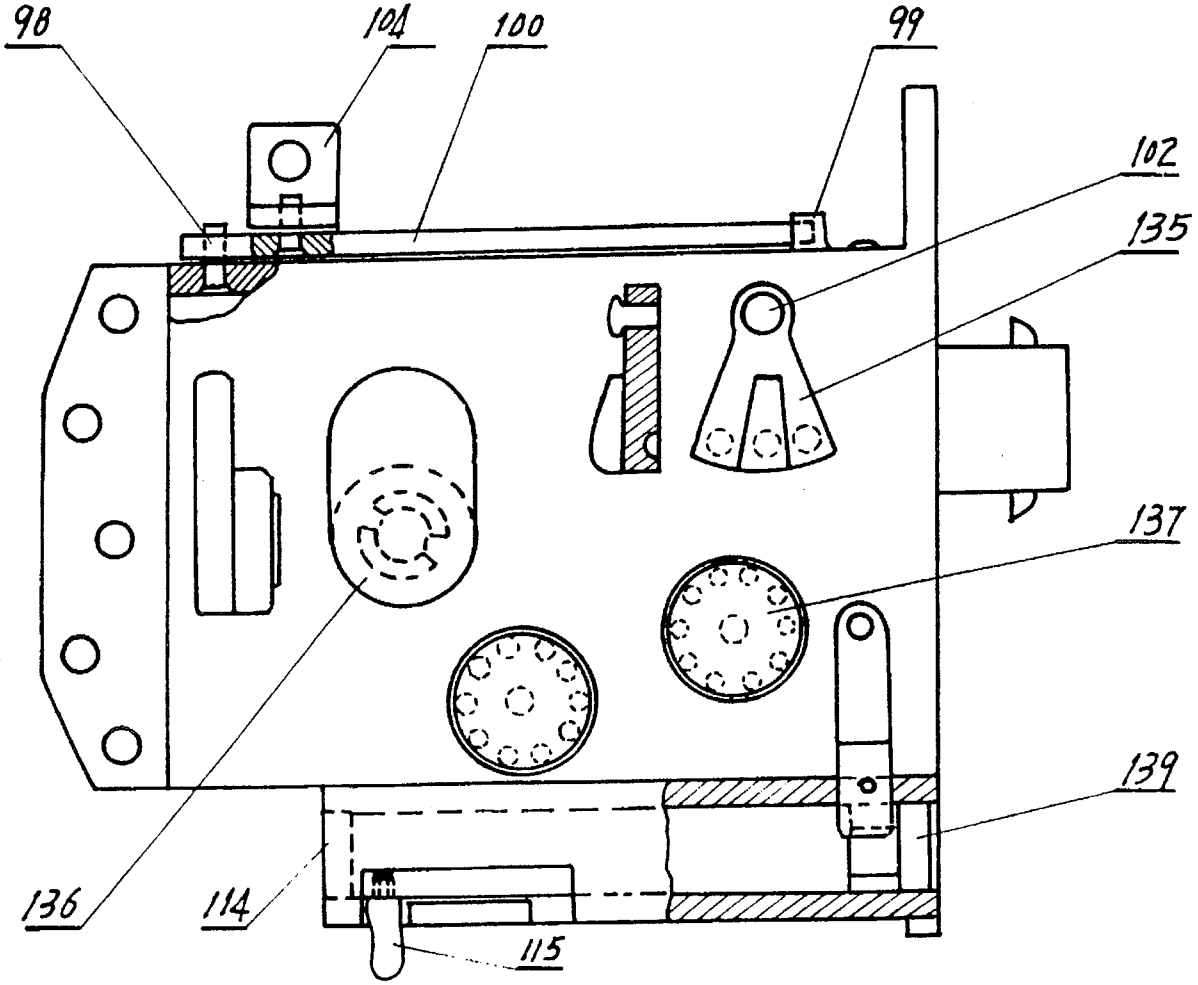
FIG. 25 is a main view of the exterior construction of the lock body according to the invention.
Figure 26:
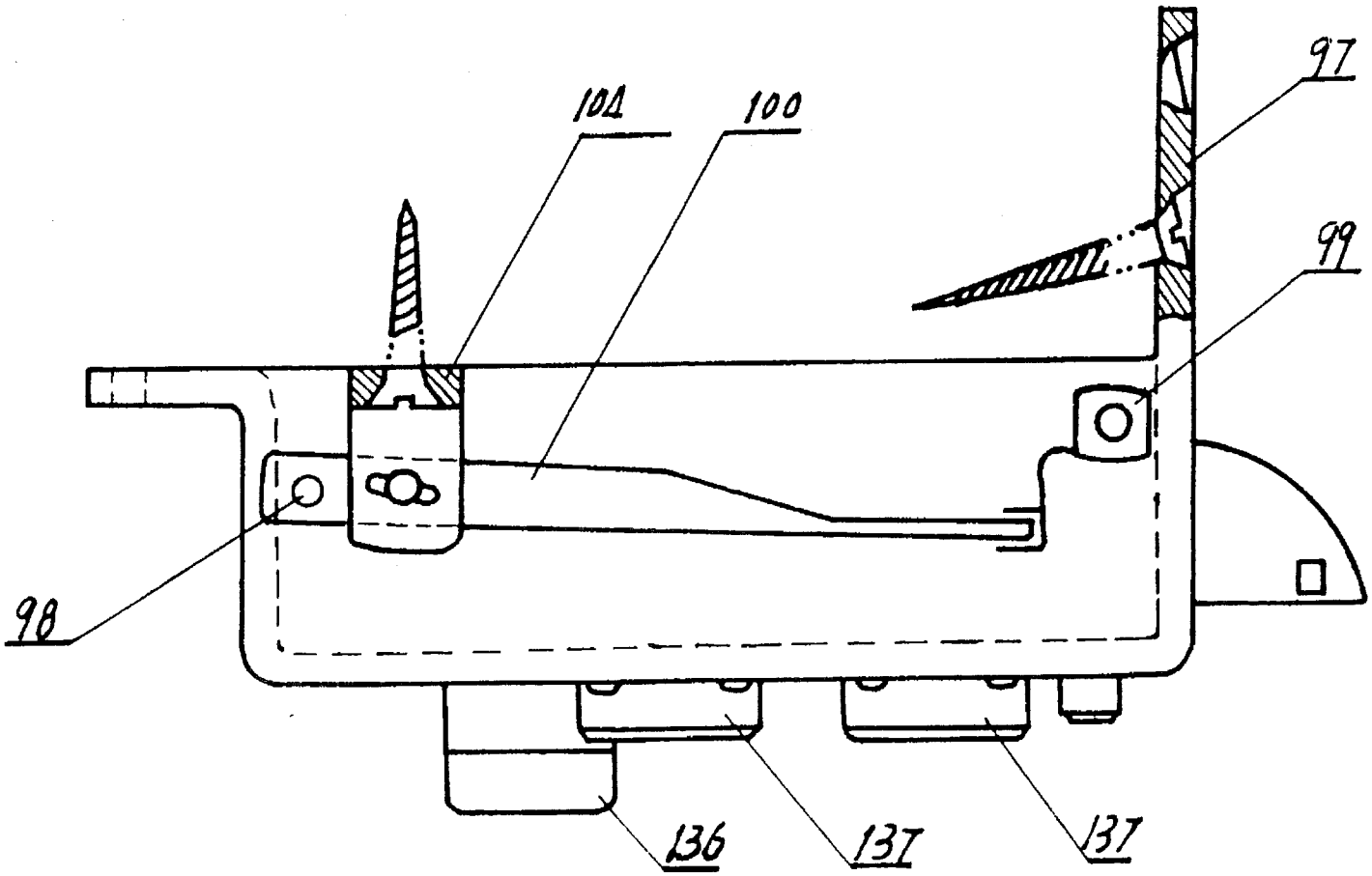
FIG. 26 is a top view of the exterior construction of the lock body according to the invention.
Figure 27:
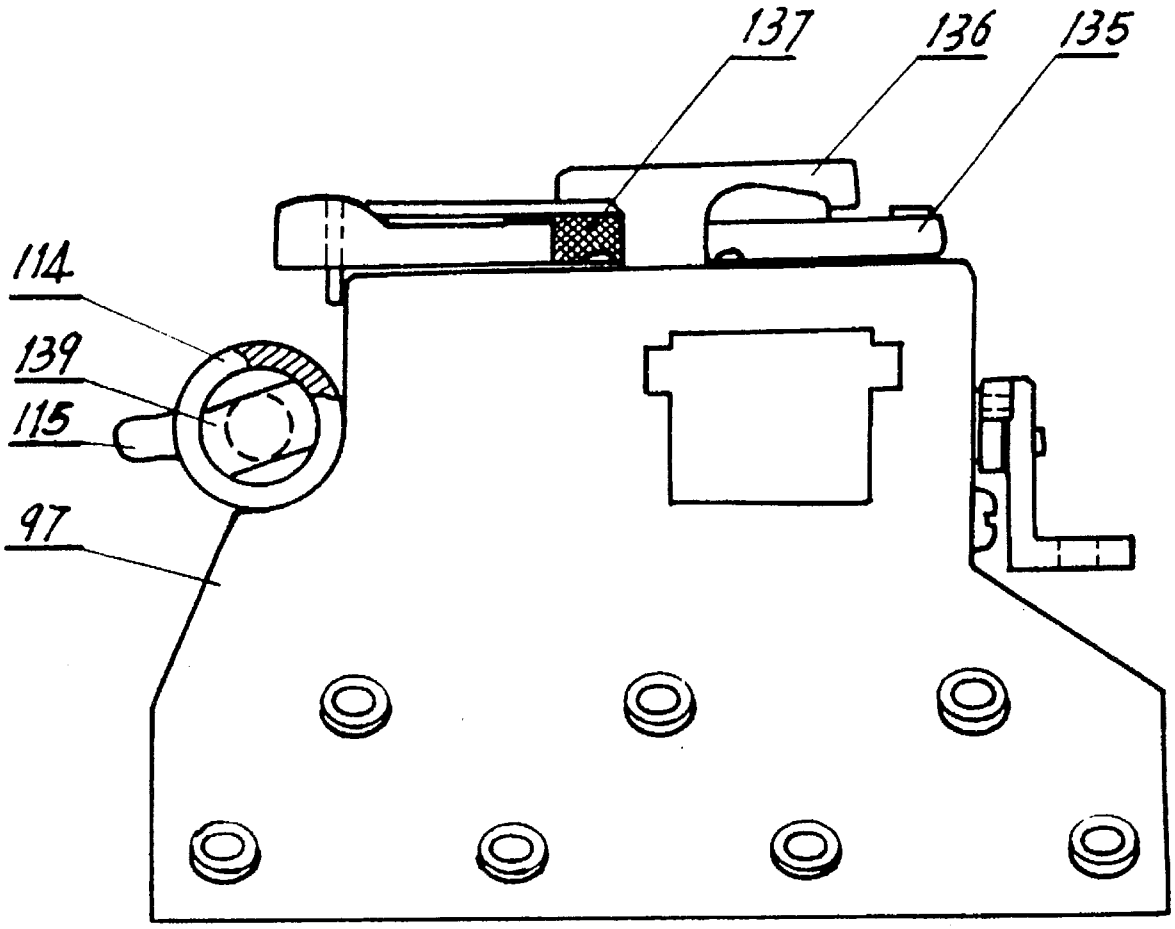
FIG. 27 is a schematic view of the side plate of the lock body portion according to the invention.
Figure 28:
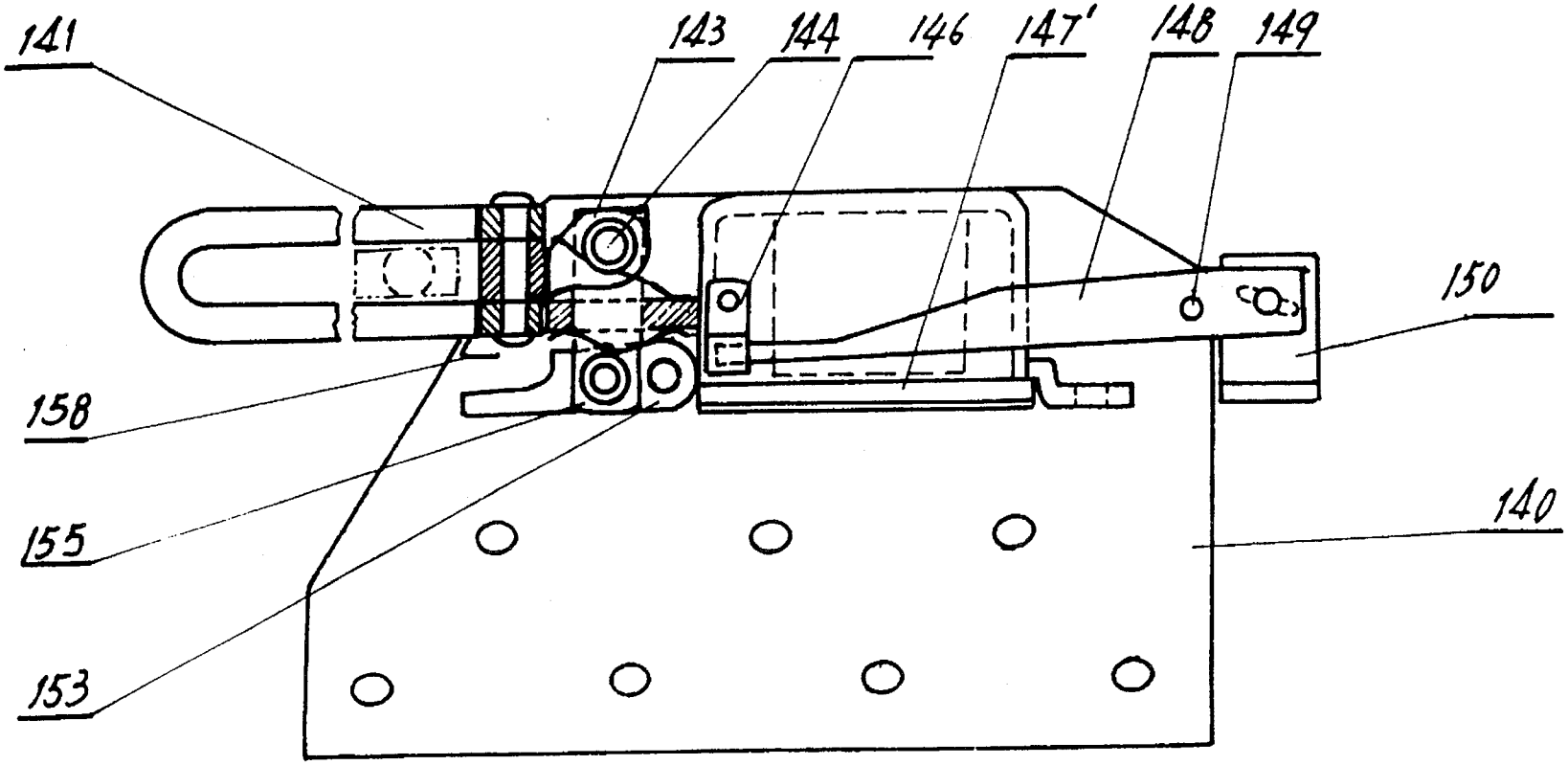
FIG. 28 is a schematic view of the tongue chamber according to the invention.
Figures 29, 29A:
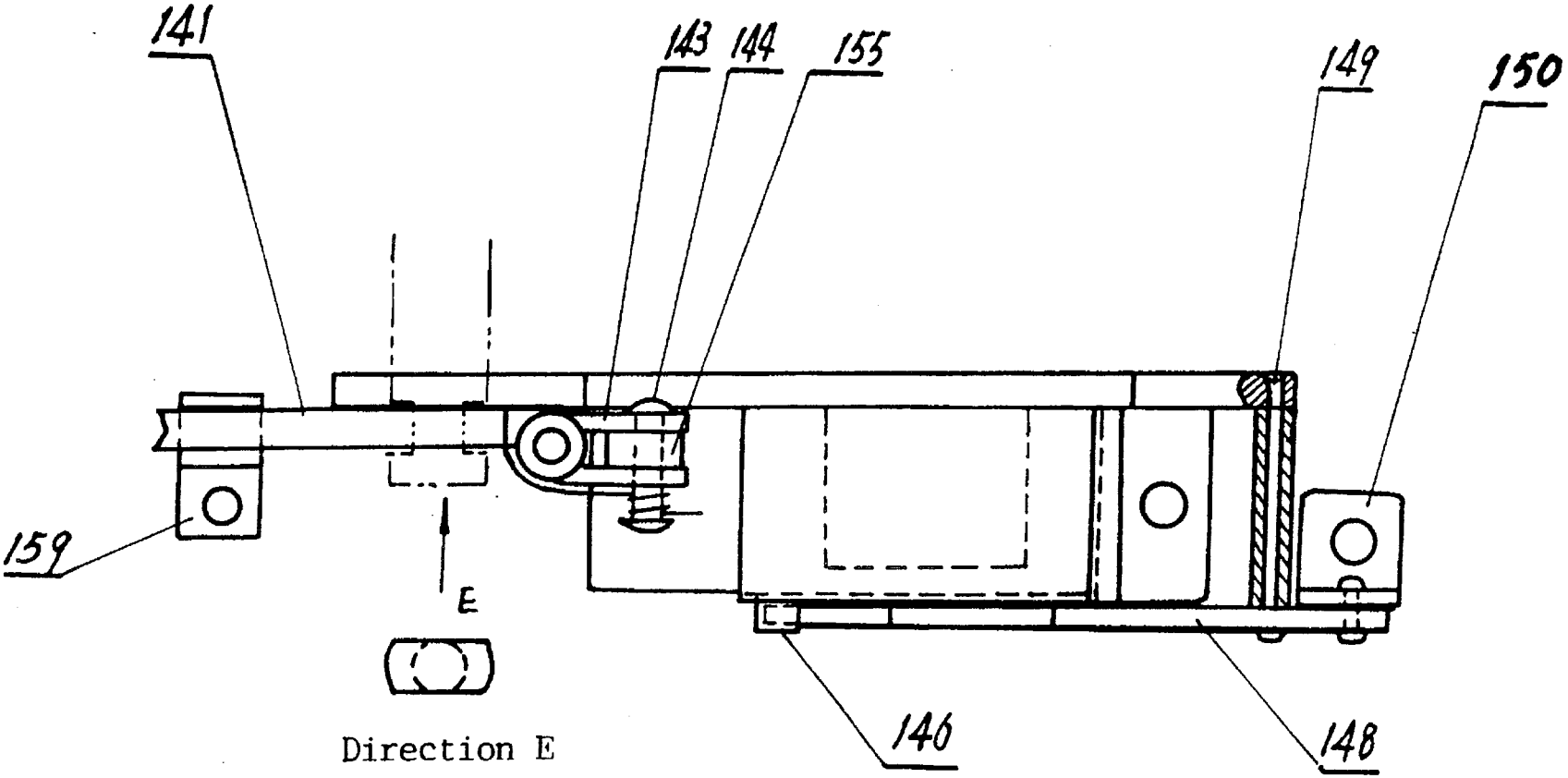
FIG. 29 is a side view of the tongue chamber according to the invention.
FIG. 29A is a view taken in the direction of arrow E in FIG. 29.

Furthermore, in the present invention an alarm mechanism to sense deformation of the door can also be provided in the lock body and the lock chamber of above embodiments, as shown in FIGS. 25, 26. One end of the alarm finger 100 is hinged to the upper surface of the lock body by a pin 98. A finger base 104 is fixed on the room door and pivotably connects with the finger 100. The relative position of the base 104 and the finger 100 can be adjusted. The end of the finger 100, which is not hinged on the lock body, is arranged to face an alarm contact sheet 99. When the door body is not deformed, the finger 100 remains idle. If the door body is damaged and deformed, then the base 104 will deform and pull the finger 100 to connect with the alarm contact sheet 99 to give alarm. As shown in FIG. 29, the similar mechanism can also be set up in the lock chamber. In FIG. 28, the numeral 146 indicates an alarm contact sheet, 148 indicates an alarm finger, 149 indicates the pivot of the finger 148, and 150 indicate a finger base.

Also, in the present invention, adhesive alarm contact sheets can be provided between the bottom plate of the lock body and the tongue chamber and the interior surface of the door, as the adhesive alarm sheet 96 shown in FIG. 24 and the adhesive alarm sheet 147' in the FIG. 28. These alarm sheets is not electric connected with the lock body and the tongue chamber by insulating papers, but the sheets and the lock body and the tongue chamber are respectively connected with the alarm electric circuit. If the destroying act such as drilling the bottom plate or beating it takes place, the drill or metal sharp tool will penetrate the adhesive sheet and the insulating paper. Due to the fact that the bottom plate and the tongue chamber as well as the adhesive alarm piece are connected with an alarm electrical circuit respectively, the adhesive piece and the lock body will be electric connected with each other through the drill or metal sharp tools to give an alarm.

In the above embodiments of the present invention as shown in FIGS. 26–29, the width of the side plate 97 of the lock body can reaches 100–120 mm and the width thereof attached to the side edge of the door can reaches 35 mm. The bolt holes in the side plate 97 is inclined toward the lock body. The corresponding parts 140 of the tongue chamber can also be set up according to the above sizes and construction, so that the destroying act applied to the lock from outside can be resisted to the greatest extent.

The alarm electric circuit used in the present invention is a general electric circuit for alarm.

It shall be noted that there is no necessity for the present invention to include all above mentioned mechanisms in a single lock. The most basic type of the lock of the present invention is that which does not includes the anti-invading mechanism, the alarm mechanism for sensing the room door deformation, the anti-moving lock tongue and the external lock portion. A lock including the lock cylinder portion and the lock body portion which fits with the ordinary lock tongue is the most basic type of the invention, and it is also the first embodiment of the invention. The T-shape pin 46 pressed by the spring piece and located on the pins which is in the back external cylinder 72 of the lock cylinder can also be replaced by the ordinary pins and pin spring. Thus the most basic type of the present invention does not contains the T-shape pin 46.

While the description of the invention has been given with respect to the preferred embodiments, it is not to be constructed in a limited sense. Variations and modification will occur to those skilled in the art. Reference is make to the appended claims for a definition of the invention.

What is claimed is:

1. A mechanical lock comprising:

a lock cylinder including a front lock cylinder, a back lock cylinder, a self-locking control mechanism, and a moving section control mechanism;

said front lock cylinder including a front external cylinder, a front middle cylinder and a front internal cylinder; two pin sets arranged longitudinally in the front cylinder; a positioning groove of the internal cylinder is in communication with a key hole, so that after rotation of the internal cylinder the positioning pin of the internal cylinder is fitted with an anti-drawout groove of a key, whereby the key is not permitted to be drawn out from the key hole;

said back lock cylinder including a back external cylinder and a back internal cylinder having a pin-set-like arrangement; said back internal cylinder being fastened rigidly together with the front middle cylinder of the front lock cylinder and said front external cylinder being fastened rigidly together with the back external cylinder; a driving rod being connected rigidly with said back internal cylinder;

said self-locking control mechanism including a self-locking control plate, connecting rods and a self-locking control rod; said self-locking control plate being located between the front and back lock cylinders and can drive the connecting rods and the self-locking control rod to move toward the front lock cylinder; the self-locking control rod extending out from the lock cylinder;

said moving section control mechanism including a V-shape element used to drive a moving section control rod to rotate a ball and bar mechanism which is raised up with rotation of the lock cylinder and then moves the bar to rotate the V-shape element, and the moving section control rod extending out from the lock cylinder;

a lock body portion including a body and a bottom plate; said bottom plate being secured on a door; an external moving section, an external moving head and a self-locking control pin arranged in series on a side of the bottom plate facing the body; said moving section control rod being fitted with said external moving section; said external moving section being used to control movement of the external moving head and can be rotated to release said external moving head by said moving section control rod; said self-locking control pin being pushed by said self-locking control rod extending into said body portion;

said driving rod from the lock cylinder being fitted with said external moving head used for controlling movement of a lock tongue;

said lock body portion includes the lock tongue; an internal moving head whose movement can be controlled from an interior of a room being provided to control a position of the lock tongue; a self-locking element with a spring alarm sheet being located below the lock tongue and hinged to the lock body portion; one end of the self-locking element being controlled by the self-locking control pin, and the other end of the self-locking element being engageable with the lock tongue when the lock tongue is inserted in a lock tongue chamber; an internal lock mechanism being provided and controlled by secret code disks;

said lock tongue chamber being provided to fit with the lock tongue.

2. A mechanical lock according to claim 1, further including an external lock portion containing a closed door, a closed door control mechanism and a pressing ring around the external lock portion;

said closed door is provided with a rod arranged rotatably in the lock cylinder, and a lock hook;

said closed door control mechanism includes the secret code disks, secret code bottom disks, each of which is connected with each of the secret code disks by a shaft and having a recess on an outer periphery thereof, a displacement element controlled by the secret code bottom disks with lower feet of the displacement element capable of insertion into the recesses of the secret code bottom disks, a knob executing element fitted with the displacement element, a knob connected pivotably with said knob executing element at one end, an L-shape operating element controlled by said knob executing element, a lock head moved by said L-shape operating element capable of locking and releasing the lock hook of the closed door, and a spring and bar mechanism to raise the door.

3. A mechanical lock according to claim 1, wherein said internal lock mechanism includes two secret code disks and an internal lock arm; a recess is formed in each bottom disk of said two secret code disks; projections are provided on the internal lock arm so that when the secret code disks are in the state that their secret codes marked thereon are in mess condition and the lock tongue is inserted in the lock tongue chamber, the internal lock arm locks the internal moving head enabling the internal moving head not to be turned by external force and when the secret code disks are in the condition that their secret codes are correctly oriented, the internal lock arm is disconnected from the internal moving head.

4. A mechanical lock according to claim 1, wherein T-shape pins pressed by spring pieces are provided in pin chambers of said back lock cylinder; alarm contact sheets insulated from the T-shape pins are provided on an outer surface of the back external cylinder and correspond to positions of the T-shape pins; said alarm contact sheets and said spring pieces are connected with an alarm electrical circuit respectively.

5. A mechanical lock according to claim 1, wherein said lock tongue is hollow and includes anti-moving heads which protrude outside the lock tongue; a control mechanism controlling the anti-moving heads is provided in the lock tongue; said control mechanism comprises levers hinged to the anti-moving heads, a cone pulling element, a lower moving wheel and an upper moving wheel; said upper and lower moving wheels are of circular segment shape and are pressed against one end of the cone pulling element, and are hinged to the lock tongue by a pin;

a reinforced plate is welded in the lock tongue.

6. A mechanical lock according to claim 1, further comprising an anti-invading mechanism which includes a moving bolt and a bush, a plate, a short element, a cross rod and an alarm rod; said bush for the moving bolt is provided below the lock body portion with the moving bolt installed inside the lock body portion; said plate is connected with the lock tongue chamber, and hinged to one end of the short element; the other end of the short element and the cross rod are hinged to the lock tongue chamber; the cross rod is also hinged to an alarm plate; an alarm contact sheet is provided on the lock tongue chamber and face, but not in contact with the alarm plate; and the alarm contact sheet and the alarm plate are connected with an alarm electrical circuit respectively.

7. A mechanical lock according to claim 1, further comprising an alarm mechanism for sensing deformation of a room door; said alarm mechanism comprises an alarm finger hinged to one of the lock body portion and the lock tongue chamber, a finger base secured on one of the room door and a door frame and also pivotably connected with the alarm finger, and an alarm contact sheet facing the alarm finger; the alarm finger and the alarm contact sheet are connected with an alarm electrical circuit respectively.

8. A mechanical lock according to claim 1, wherein alarm contact sheets are provided between the bottom plate of said lock body portion and a door and between a bottom plate of the lock tongue chamber and corresponding portion of a door frame; insulating papers are provided between said alarm contact sheet and corresponding portions of the lock body portion, the lock tongue chamber, the door and the door frame; said alarm contact sheets and said corresponding portions are connected with an alarm electrical circuit respectively.

9. A mechanical lock according to claim 1, wherein a width of side plates of the lock tongue and the lock tongue chamber are 100–120 mm, bolt holes on said side plates are inclined and oriented toward the lock body portion and the lock tongue chamber respectively.

10. A key adapted to fit with the mechanical lock of claim 1 comprises two upper bit surfaces for two sets of longitudinally arranged pins, a longitudinal bit surface, a groove at a bottom side and two steps.

* * * * *